US007134381B2

(12) United States Patent
Ueno et al.

(10) Patent No.: US 7,134,381 B2
(45) Date of Patent: Nov. 14, 2006

(54) REFRIGERANT COMPRESSOR AND FRICTION CONTROL PROCESS THEREFOR

(75) Inventors: Takafumi Ueno, Yokohama (JP); Makoto Kano, Yokohama (JP); Takahiro Hamada, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/921,346

(22) Filed: Aug. 19, 2004

(65) Prior Publication Data

US 2005/0084390 A1 Apr. 21, 2005

(30) Foreign Application Priority Data

Aug. 21, 2003 (JP) ..... 2003-208282
Jul. 16, 2004 (JP) ..... 2004-209495

(51) Int. Cl.
*F01B 31/10* (2006.01)

(52) U.S. Cl. ..... 92/71; 92/154; 92/155

(58) Field of Classification Search ..... 92/12.2, 92/71, 72, 154, 155
See application file for complete search history.

(56) References Cited

U.S. PATENT DOCUMENTS

| | | | |
|---|---|---|---|
| 1,461 | A | 12/1839 | Day |
| 2,716,972 | A | 9/1955 | Farny et al. |
| 2,982,733 | A | 5/1961 | Wright et al. |
| 3,211,647 | A | 10/1965 | O'Halloran et al. |
| 3,790,315 | A | 2/1974 | Emanuelsson et al. |
| 3,846,162 | A | 11/1974 | Bloom |
| 3,932,228 | A | 1/1976 | Sugiyama et al. |
| 4,031,023 | A | 6/1977 | Musser et al. |
| 4,367,130 | A | 1/1983 | Lemelson |
| 4,385,880 | A | 5/1983 | Lemelson |
| 4,538,929 | A | 9/1985 | Ehrentraut et al. |
| 4,554,208 | A | 11/1985 | MacIver et al. |
| 4,645,610 | A | 2/1987 | Born et al. |
| 4,702,808 | A | 10/1987 | Lemelson |
| 4,712,982 | A | 12/1987 | Inagaki et al. |
| 4,755,237 | A | 7/1988 | Lemelson |
| 4,755,426 | A | 7/1988 | Kokai et al. |
| 4,783,368 | A | 11/1988 | Yamamoto et al. |
| 4,834,400 | A | 5/1989 | Lebeck |
| 4,842,755 | A | 6/1989 | Dunn |
| 4,859,493 | A | 8/1989 | Lemelson |
| 4,874,596 | A | 10/1989 | Lemelson |
| 4,919,974 | A | 4/1990 | McCune et al. |
| 4,933,058 | A | 6/1990 | Bache et al. |
| 4,943,345 | A | 7/1990 | Asmussen et al. |
| 4,960,643 | A | 10/1990 | Lemelson |

(Continued)

FOREIGN PATENT DOCUMENTS

| | | |
|---|---|---|
| CA | 2009582 | 8/1990 |

(Continued)

OTHER PUBLICATIONS

U.S. Appl. No. 09/545,181, filed Apr. 7, 2000, Miyake et al.

(Continued)

*Primary Examiner*—Edward K. Look
*Assistant Examiner*—Michael Leslie
(74) *Attorney, Agent, or Firm*—Foley & Lardner LLP

(57) ABSTRACT

There is provided a refrigerant compressor including compressor parts having sliding portions slidable relative to each other and a refrigeration oil applied to the sliding portions of the compressor parts. At least one of the sliding portions of the compressor parts has a hard carbon coating formed thereon with a hydrogen content of 20 atomic % or less.

26 Claims, 3 Drawing Sheets

U.S. PATENT DOCUMENTS

| | | | | |
|---|---|---|---|---|
| 4,974,498 | A | | 12/1990 | Lemelson |
| 4,980,021 | A | | 12/1990 | Kitamura et al. |
| 4,980,610 | A | | 12/1990 | Varga |
| 4,981,717 | A | | 1/1991 | Thaler |
| 4,988,421 | A | | 1/1991 | Drawl et al. |
| 4,992,082 | A | | 2/1991 | Drawl et al. |
| 5,000,541 | A | | 3/1991 | DiMarcello et al. |
| 5,021,628 | A | | 6/1991 | Lemelson |
| 5,032,243 | A | | 7/1991 | Bache et al. |
| 5,036,211 | A | | 7/1991 | Scott |
| 5,040,501 | A | | 8/1991 | Lemelson |
| 5,067,826 | A | | 11/1991 | Lemelson |
| 5,077,990 | A | | 1/1992 | Plath |
| 5,078,848 | A | | 1/1992 | Anttila et al. |
| 5,087,608 | A | | 2/1992 | Chan et al. |
| 5,096,352 | A | | 3/1992 | Lemelson |
| 5,110,435 | A | | 5/1992 | Haberland |
| 5,112,025 | A | | 5/1992 | Nakayama et al. |
| 5,127,314 | A | * | 7/1992 | Swain ..... 92/12.2 |
| 5,131,941 | A | | 7/1992 | Lemelson |
| 5,132,587 | A | | 7/1992 | Lemelson |
| 5,142,785 | A | | 9/1992 | Grewal et al. |
| 5,143,634 | A | | 9/1992 | Quinga et al. |
| 5,148,780 | A | | 9/1992 | Urano et al. |
| 5,187,021 | A | | 2/1993 | Vydra et al. |
| 5,190,807 | A | | 3/1993 | Kimock et al. |
| 5,190,824 | A | | 3/1993 | Itoh |
| 5,202,156 | A | | 4/1993 | Yamamoto et al. |
| 5,205,188 | A | | 4/1993 | Repenning et al. |
| 5,205,305 | A | | 4/1993 | Yamakita |
| H1210 | H | | 7/1993 | Jansen |
| 5,232,568 | A | | 8/1993 | Parent et al. |
| 5,237,967 | A | | 8/1993 | Willermet et al. |
| 5,249,554 | A | | 10/1993 | Tamor et al. |
| 5,255,783 | A | | 10/1993 | Goodman et al. |
| 5,255,929 | A | | 10/1993 | Lemelson |
| 5,284,394 | A | | 2/1994 | Lemelson |
| 5,288,556 | A | | 2/1994 | Lemelson |
| 5,295,305 | A | | 3/1994 | Hahn et al. |
| 5,299,937 | A | | 4/1994 | Gow |
| 5,317,938 | A | | 6/1994 | de Juan, Jr. et al. |
| 5,326,488 | A | | 7/1994 | Minokami et al. |
| 5,332,348 | A | | 7/1994 | Lemelson |
| 5,334,306 | A | | 8/1994 | Dautremont-Smith et al. |
| 5,349,265 | A | | 9/1994 | Lemelson |
| 5,358,402 | A | | 10/1994 | Reed et al. |
| 5,359,170 | A | | 10/1994 | Chen et al. |
| 5,360,227 | A | | 11/1994 | Lemelson |
| 5,380,196 | A | | 1/1995 | Kelly et al. |
| 5,401,543 | A | | 3/1995 | O'Neill et al. |
| H1461 | H | | 7/1995 | DiVita et al. |
| 5,432,539 | A | | 7/1995 | Anderson |
| 5,433,977 | A | | 7/1995 | Sarin et al. |
| H1471 | H | | 8/1995 | Braun et al. |
| 5,443,032 | A | | 8/1995 | Vichr et al. |
| 5,447,208 | A | | 9/1995 | Lund et al. |
| 5,456,406 | A | | 10/1995 | Lemelson |
| 5,458,754 | A | | 10/1995 | Sathrum et al. |
| 5,461,648 | A | | 10/1995 | Nauflett et al. |
| 5,462,772 | A | | 10/1995 | Lemelson |
| 5,464,667 | A | | 11/1995 | Köhler et al. |
| 5,466,431 | A | | 11/1995 | Dorfman et al. |
| 5,479,069 | A | | 12/1995 | Winsor |
| 5,482,602 | A | | 1/1996 | Cooper et al. |
| 5,491,028 | A | | 2/1996 | Sarin et al. |
| 5,497,550 | A | | 3/1996 | Trotta et al. |
| 5,509,841 | A | | 4/1996 | Winsor |
| 5,516,729 | A | | 5/1996 | Dawson et al. |
| 5,529,815 | A | | 6/1996 | Lemelson |
| 5,531,878 | A | | 7/1996 | Vadgama et al. |
| 5,541,566 | A | | 7/1996 | Deeney |
| 5,547,716 | A | | 8/1996 | Thaler |
| 5,551,959 | A | | 9/1996 | Martin et al. |
| 5,552,675 | A | | 9/1996 | Lemelson |
| 5,568,391 | A | | 10/1996 | Mckee |
| 5,593,719 | A | | 1/1997 | Dearnaley et al. |
| 5,616,372 | A | | 4/1997 | Conley et al. |
| 5,619,889 | A | | 4/1997 | Jones et al. |
| 5,628,881 | A | | 5/1997 | Lemelson |
| 5,630,275 | A | | 5/1997 | Wexler |
| 5,630,953 | A | | 5/1997 | Klink |
| 5,653,300 | A | | 8/1997 | Lund et al. |
| 5,669,144 | A | | 9/1997 | Hahn et al. |
| 5,672,054 | A | | 9/1997 | Cooper et al. |
| 5,688,557 | A | | 11/1997 | Lemelson et al. |
| 5,707,409 | A | | 1/1998 | Martin et al. |
| 5,714,202 | A | | 2/1998 | Lemelson et al. |
| 5,719,109 | A | | 2/1998 | Tokashiki et al. |
| 5,723,207 | A | | 3/1998 | Lettington et al. |
| 5,731,046 | A | | 3/1998 | Mistry et al. |
| 5,735,769 | A | | 4/1998 | Takemura et al. |
| 5,740,941 | A | | 4/1998 | Lemelson |
| 5,775,817 | A | | 7/1998 | Gottemoller et al. |
| 5,786,038 | A | | 7/1998 | Conley et al. |
| 5,790,146 | A | | 8/1998 | Anderson |
| 5,793,390 | A | | 8/1998 | Claflin et al. |
| 5,794,801 | A | | 8/1998 | Lemelson |
| 5,799,549 | A | | 9/1998 | Decker et al. |
| 5,806,557 | A | | 9/1998 | Helge |
| 5,824,387 | A | | 10/1998 | Boutaghou et al. |
| 5,834,708 | A | | 11/1998 | Svetal et al. |
| 5,840,662 | A | | 11/1998 | Nibert et al. |
| 5,843,571 | A | | 12/1998 | Sho |
| 5,851,962 | A | | 12/1998 | Kaga |
| 5,866,195 | A | | 2/1999 | Lemelson |
| 5,871,805 | A | | 2/1999 | Lemelson |
| 5,881,444 | A | | 3/1999 | Schaefer et al. |
| 5,901,021 | A | | 5/1999 | Hirano et al. |
| 5,910,940 | A | | 6/1999 | Guerra |
| 5,927,897 | A | | 7/1999 | Attar |
| 5,937,812 | A | | 8/1999 | Reedy et al. |
| 5,940,975 | A | | 8/1999 | Decker et al. |
| 5,945,214 | A | | 8/1999 | Ma et al. |
| 5,947,710 | A | | 9/1999 | Cooper et al. |
| 5,952,102 | A | | 9/1999 | Cutler |
| 5,958,261 | A | | 9/1999 | Offer et al. |
| 5,960,762 | A | | 10/1999 | Imai |
| 5,967,250 | A | | 10/1999 | Lund et al. |
| 5,968,596 | A | | 10/1999 | Ma et al. |
| 5,975,686 | A | | 11/1999 | Hauck et al. |
| 5,976,707 | A | | 11/1999 | Grab |
| 5,992,268 | A | | 11/1999 | Decker et al. |
| 5,993,938 | A | | 11/1999 | Tsukuda et al. |
| 6,006,415 | A | | 12/1999 | Schaefer et al. |
| 6,015,597 | A | | 1/2000 | David |
| 6,016,000 | A | | 1/2000 | Moslehi |
| 6,023,979 | A | | 2/2000 | Bills et al. |
| 6,028,393 | A | | 2/2000 | Izu et al. |
| 6,051,298 | A | | 4/2000 | Ko et al. |
| 6,056,443 | A | | 5/2000 | Koike et al. |
| 6,059,460 | A | | 5/2000 | Ono et al. |
| 6,059,830 | A | | 5/2000 | Lippincott, III et al. |
| 6,071,597 | A | | 6/2000 | Yang et al. |
| 6,083,313 | A | | 7/2000 | Venkatraman et al. |
| 6,083,570 | A | * | 7/2000 | Lemelson et al. ..... 427/554 |
| 6,095,690 | A | | 8/2000 | Niegel et al. |
| 6,099,541 | A | | 8/2000 | Klopotek |
| 6,099,976 | A | | 8/2000 | Lemelson et al. |
| 6,106,919 | A | | 8/2000 | Lee et al. |
| 6,124,198 | A | | 9/2000 | Moslehi |
| 6,139,964 | A | | 10/2000 | Sathrum et al. |
| 6,142,481 | A | | 11/2000 | Iwashita et al. |
| 6,145,608 | A | | 11/2000 | Lund et al. |
| 6,156,439 | A | | 12/2000 | Coffinberry |

6,159,558 A 12/2000 Wolfe et al.
6,160,683 A 12/2000 Boutaghou
6,165,616 A 12/2000 Lemelson et al.
6,170,156 B1 1/2001 Lev et al.
6,171,343 B1 1/2001 Dearnaley et al.
6,173,913 B1 1/2001 Shafer et al.
6,190,514 B1 2/2001 Ma et al.
6,193,906 B1 2/2001 Kaneko et al.
6,197,120 B1 3/2001 David
6,197,428 B1 3/2001 Rogers
6,203,651 B1 3/2001 Järvenkylä et al.
6,205,291 B1 3/2001 Hughes et al.
6,207,625 B1 3/2001 Ogano et al.
6,227,056 B1 5/2001 Bills et al.
6,237,441 B1 5/2001 Nishioka et al.
6,237,852 B1 5/2001 Svetal et al.
6,238,839 B1 5/2001 Tomita et al.
6,255,262 B1 7/2001 Keenan et al.
6,261,424 B1 7/2001 Goncharenko et al.
6,273,793 B1 8/2001 Liners et al.
6,274,220 B1 8/2001 Tsukuda et al.
6,289,593 B1 9/2001 Decker et al.
6,293,648 B1 9/2001 Anderson
6,296,552 B1 10/2001 Boutaghou et al.
6,299,425 B1 * 10/2001 Hirano et al. ..... 418/63
6,305,416 B1 10/2001 Snel et al.
6,309,283 B1 10/2001 Liners et al.
6,311,524 B1 11/2001 Brennan, III et al.
6,316,734 B1 11/2001 Yang
6,322,431 B1 11/2001 Schaenzer et al.
6,322,719 B1 11/2001 Kaneko et al.
6,324,060 B1 11/2001 Hsu
6,325,385 B1 12/2001 Iwashita et al.
6,329,328 B1 12/2001 Koganei et al.
6,333,298 B1 12/2001 Waddoups et al.
6,338,881 B1 1/2002 Sellschopp et al.
6,340,245 B1 1/2002 Horton et al.
6,358,123 B1 3/2002 Liners et al.
6,367,705 B1 4/2002 Lee et al.
6,368,676 B1 4/2002 Gaudreau et al.
6,377,422 B1 4/2002 Boutaghou et al.
6,379,383 B1 4/2002 Palmaz et al.
6,385,987 B1 5/2002 Schlom et al.
6,386,468 B1 5/2002 Neuberger et al.
6,399,215 B1 6/2002 Zhu et al.
6,401,058 B1 6/2002 Akalin et al.
6,439,845 B1 8/2002 Veres
6,439,986 B1 8/2002 Myoung et al.
6,452,752 B1 9/2002 Boutaghou
6,468,642 B1 10/2002 Bray et al.
6,471,979 B1 10/2002 New et al.
6,494,881 B1 12/2002 Bales et al.
6,523,456 B1 2/2003 Kobayashi et al.
6,524,212 B1 2/2003 Ushijima et al.
6,534,141 B1 3/2003 Hull, Jr. et al.
6,537,310 B1 3/2003 Palmaz et al.
6,537,429 B1 3/2003 O'Donnell et al.
6,543,394 B1 4/2003 Tinney
6,544,308 B1 4/2003 Griffin et al.
6,553,957 B1 4/2003 Ishikawa et al.
6,557,968 B1 5/2003 Lee et al.
6,562,445 B1 5/2003 Iwamura
6,562,462 B1 5/2003 Griffin et al.
6,570,172 B1 5/2003 Kim et al.
6,572,651 B1 6/2003 De Scheerder et al.
6,572,935 B1 6/2003 He et al.
6,572,937 B1 6/2003 Hakovirta et al.
6,585,064 B1 7/2003 Griffin et al.
6,586,069 B1 7/2003 Dykes et al.
6,589,640 B1 7/2003 Griffin et al.
6,592,519 B1 7/2003 Martinez
6,592,985 B1 7/2003 Griffin et al.
6,601,662 B1 8/2003 Matthias et al.
6,626,949 B1 9/2003 Townley
6,629,906 B1 10/2003 Chiba et al.
6,637,528 B1 10/2003 Nishiyama et al.
6,638,569 B1 10/2003 McLaughlin et al.
6,645,354 B1 11/2003 Gorokhovsky
6,656,329 B1 12/2003 Ma et al.
6,658,941 B1 12/2003 Bills et al.
6,666,328 B1 12/2003 Sykora
6,666,671 B1 12/2003 Olver et al.
6,684,513 B1 2/2004 Clipstone et al.
6,684,759 B1 2/2004 Gorokhovsky
6,695,865 B1 2/2004 Boyle et al.
6,699,106 B1 3/2004 Myoung et al.
6,701,627 B1 3/2004 Korb et al.
6,715,693 B1 4/2004 Dam et al.
6,726,993 B1 4/2004 Teer et al.
6,729,350 B1 5/2004 Schick
6,729,527 B1 5/2004 Sonnenreich et al.
6,733,513 B1 5/2004 Boyle et al.
6,739,214 B1 5/2004 Griffin et al.
6,739,238 B1 5/2004 Ushijima et al.
6,740,393 B1 5/2004 Massler et al.
6,745,742 B1 6/2004 Meyer
6,749,033 B1 6/2004 Griffin et al.
6,753,042 B1 6/2004 Bokounine et al.
6,753,635 B1 6/2004 Kuhlmann-Wilsdorf
6,761,532 B1 7/2004 Capone et al.
6,761,736 B1 7/2004 Woo et al.
6,780,177 B1 8/2004 Shafirstein et al.
6,797,326 B1 9/2004 Griffin et al.
6,799,468 B1 10/2004 Borenstein
6,806,242 B1 10/2004 Shirahama et al.
6,818,029 B1 11/2004 Myoung et al.
6,820,676 B1 11/2004 Palmaz et al.
6,821,189 B1 11/2004 Coad et al.
6,821,624 B1 11/2004 Utsumi et al.
6,822,788 B1 11/2004 Blitstein
6,849,085 B1 2/2005 Marton
6,855,237 B1 2/2005 Kolpakov et al.
6,855,791 B1 2/2005 Van Doren et al.
6,861,098 B1 3/2005 Griffin et al.
6,861,137 B1 3/2005 Griffin et al.
6,865,952 B1 3/2005 Bills et al.
6,866,894 B1 3/2005 Trankiem et al.
6,871,700 B1 3/2005 Gorokhovsky
6,872,203 B1 3/2005 Shafirstein et al.
6,878,447 B1 4/2005 Griffin et al.
6,880,469 B1 4/2005 Frost
6,882,094 B1 4/2005 Dimitrijevic et al.
6,883,476 B1 4/2005 Nohara et al.
6,886,521 B1 5/2005 Hamada et al.
6,887,585 B1 5/2005 Herbst-Dederichs
6,890,700 B1 5/2005 Tomita et al.
6,893,720 B1 5/2005 Nakahigashi et al.
6,969,198 B1 11/2005 Konishi et al.
2001/0036800 A1 11/2001 Liners et al.
2002/0026899 A1 3/2002 McLaughlin et al.
2002/0031987 A1 3/2002 Liners et al.
2002/0034631 A1 3/2002 Griffin et al.
2002/0034632 A1 3/2002 Griffin et al.
2002/0051286 A1 5/2002 Blitstein
2002/0070357 A1 6/2002 Kim et al.
2002/0074168 A1 6/2002 Matthias et al.
2002/0089571 A1 7/2002 Lee
2002/0090155 A1 7/2002 Ushijima et al.
2002/0090578 A1 7/2002 Schaefera et al.
2002/0130219 A1 9/2002 Parseghian et al.
2002/0148430 A1 10/2002 Kano et al.
2002/0155015 A1 10/2002 Esumi et al.
2002/0175476 A1 11/2002 Chinou et al.
2003/0012234 A1 1/2003 Watson et al.
2003/0019111 A1 1/2003 Korb et al.
2003/0019332 A1 1/2003 Korb et al.

| | | | |
|---|---|---|---|
| 2003/0021995 | A1 | 1/2003 | Griffin et al. |
| 2003/0034182 | A1 | 2/2003 | Griffin et al. |
| 2003/0035957 | A1 | 2/2003 | Griffin et al. |
| 2003/0035958 | A1 | 2/2003 | Griffin et al. |
| 2003/0036341 | A1 | 2/2003 | Myoung et al. |
| 2003/0037640 | A1 | 2/2003 | Griffin et al. |
| 2003/0069632 | A1 | 4/2003 | De Scheerder et al. |
| 2003/0108777 | A1 | 6/2003 | Gunsel et al. |
| 2003/0114094 | A1 | 6/2003 | Myoung et al. |
| 2003/0128903 | A1 | 7/2003 | Yasuda et al. |
| 2003/0159919 | A1 | 8/2003 | Fairbairn et al. |
| 2003/0162672 | A1 | 8/2003 | Shirahama et al. |
| 2003/0168323 | A1 | 9/2003 | Frost |
| 2003/0180565 | A1 | 9/2003 | Herbst-Dederichs |
| 2003/0199741 | A1 | 10/2003 | Martinez |
| 2003/0234371 | A1 | 12/2003 | Ziegler |
| 2003/0235691 | A1 | 12/2003 | Griffin et al. |
| 2004/0003638 | A1 | 1/2004 | Schaefer et al. |
| 2004/0008406 | A1 | 1/2004 | Blitstein |
| 2004/0010068 | A1 | 1/2004 | Doren et al. |
| 2004/0011900 | A1 | 1/2004 | Gebhardt et al. |
| 2004/0027018 | A1 | 2/2004 | LeBlanc et al. |
| 2004/0035375 | A1 | 2/2004 | Gibisch et al. |
| 2004/0074467 | A1 | 4/2004 | Hamada et al. |
| 2004/0092405 | A1 | 5/2004 | Konishi et al. |
| 2004/0105806 | A1 | 6/2004 | Griffin et al. |
| 2004/0109621 | A1 | 6/2004 | Frost |
| 2004/0115435 | A1 | 6/2004 | Griffin et al. |
| 2004/0133301 | A1 | 7/2004 | Van Doren et al. |
| 2004/0154570 | A1 | 8/2004 | Mabuchi et al. |
| 2004/0168326 | A1 | 9/2004 | Korb et al. |
| 2004/0184687 | A1 | 9/2004 | Morales et al. |
| 2004/0223256 | A1 | 11/2004 | Feng et al. |
| 2004/0241448 | A1 | 12/2004 | Kano et al. |
| 2004/0242435 | A1 | 12/2004 | Nishimura et al. |
| 2004/0244539 | A1 | 12/2004 | Korb et al. |
| 2004/0261614 | A1 | 12/2004 | Hamada et al. |
| 2005/0001201 | A1 | 1/2005 | Bocko et al. |
| 2005/0005892 | A1 | 1/2005 | Nishimura et al. |
| 2005/0025975 | A1 | 2/2005 | Okamoto et al. |
| 2005/0035222 | A1 | 2/2005 | Hamada et al. |
| 2005/0037879 | A1 | 2/2005 | Murata et al. |
| 2005/0056241 | A1 | 3/2005 | Nomura et al. |
| 2005/0061291 | A1 | 3/2005 | Nishimura et al. |
| 2005/0061636 | A1 | 3/2005 | Frost et al. |
| 2005/0064196 | A1 | 3/2005 | Martin et al. |
| 2005/0082139 | A1 | 4/2005 | Ishikawa et al. |
| 2005/0089685 | A1 | 4/2005 | Hamada et al. |
| 2005/0098134 | A1 | 5/2005 | Nishimura et al. |
| 2005/0100701 | A1 | 5/2005 | Hamada et al. |
| 2005/0115744 | A1 | 6/2005 | Griffin et al. |
| 2005/0188942 | A1 | 9/2005 | Hamada et al. |

FOREIGN PATENT DOCUMENTS

| | | | |
|---|---|---|---|
| DE | 643 034 | | 3/1937 |
| DE | 19507086 | A1 | 9/1996 |
| DE | 19507086 | C2 | 9/1996 |
| DE | 197 04 224 | | 8/1997 |
| DE | 198 15 989 | | 10/1999 |
| DE | 198 25 860 | | 12/1999 |
| DE | 19825860 | A1 | 12/1999 |
| DE | 100 17 459 | A1 | 10/2000 |
| DE | 100 61 697 | A1 | 5/2002 |
| DE | 101 58 683 | | 6/2003 |
| DE | 103 18 135 | | 11/2003 |
| DE | 10337559 | A1 | 3/2005 |
| EP | 0 286 996 | | 10/1988 |
| EP | 0 291 006 | A2 | 11/1988 |
| EP | 0 299 785 | | 1/1989 |
| EP | 0308143 | B1 | 3/1989 |
| EP | 0 333 416 | | 9/1989 |
| EP | 0378378 | A1 | 7/1990 |
| EP | 0384772 | A1 | 8/1990 |
| EP | 0388800 | A2 | 9/1990 |
| EP | 0392125 | A1 | 10/1990 |
| EP | 0398985 | B1 | 11/1990 |
| EP | 407977 | | 1/1991 |
| EP | 0 435 312 | | 7/1991 |
| EP | 0474369 | A1 | 3/1992 |
| EP | 0 500 253 | | 8/1992 |
| EP | 0511153 | A1 | 10/1992 |
| EP | 0 529 327 | | 3/1993 |
| EP | 0392125 | B1 | 3/1993 |
| EP | 0546824 | A1 | 6/1993 |
| EP | 0308143 | A1 | 11/1993 |
| EP | 0573943 | A1 | 12/1993 |
| EP | 0619504 | A1 | 10/1994 |
| EP | 0621136 | A2 | 10/1994 |
| EP | 0624353 | A3 | 11/1994 |
| EP | 0624354 | A3 | 11/1994 |
| EP | 0378378 | B1 | 1/1995 |
| EP | 0651069 | A1 | 5/1995 |
| EP | 0652301 | A1 | 5/1995 |
| EP | 0656458 | A3 | 6/1995 |
| EP | 0 661 470 | | 7/1995 |
| EP | 0396603 | B1 | 6/1996 |
| EP | 0388800 | B1 | 12/1996 |
| EP | 0 759 519 | | 2/1997 |
| EP | 0474369 | B1 | 3/1997 |
| EP | 0 818 622 | | 1/1998 |
| EP | 0652301 | B1 | 1/1998 |
| EP | 0826790 | A1 | 3/1998 |
| EP | 0842754 | A1 | 5/1998 |
| EP | 0 870 820 | | 10/1998 |
| EP | 0816112 | A3 | 10/1998 |
| EP | 0882759 | A1 | 12/1998 |
| EP | 0893677 | B1 | 1/1999 |
| EP | 0624353 | B1 | 2/1999 |
| EP | 0656458 | B1 | 2/1999 |
| EP | 0 905 221 | A1 | 3/1999 |
| EP | 0 905 419 | | 3/1999 |
| EP | 0647318 | B1 | 3/1999 |
| EP | 0651069 | B1 | 3/1999 |
| EP | 0 731 190 | B1 | 5/1999 |
| EP | 0949200 | A1 | 10/1999 |
| EP | 0845154 | B1 | 11/1999 |
| EP | 0624354 | B1 | 12/1999 |
| EP | 0582676 | B1 | 3/2000 |
| EP | 1063085 | A1 | 12/2000 |
| EP | 1 067 211 | A1 | 1/2001 |
| EP | 0850126 | B1 | 1/2001 |
| EP | 1076087 | | 2/2001 |
| EP | 1078736 | A1 | 2/2001 |
| EP | 1109196 | A1 | 6/2001 |
| EP | 0778902 | B1 | 9/2001 |
| EP | 1 154 012 | | 11/2001 |
| EP | 0826790 | B1 | 11/2001 |
| EP | 1034320 | B1 | 12/2001 |
| EP | 0850133 | B1 | 1/2002 |
| EP | 0893677 | B1 | 1/2002 |
| EP | 1184480 | A2 | 3/2002 |
| EP | 1190791 | A3 | 4/2002 |
| EP | 1219464 | A2 | 7/2002 |
| EP | 1 233 054 | A1 | 8/2002 |
| EP | 0971812 | B1 | 10/2002 |
| EP | 1018291 | B1 | 10/2002 |
| EP | 1281513 | A2 | 2/2003 |
| EP | 1 300 608 | | 4/2003 |
| EP | 0950123 | B1 | 5/2003 |
| EP | 0882759 | B1 | 6/2003 |
| EP | 1 338 641 | | 8/2003 |
| EP | 1340605 | A1 | 9/2003 |
| EP | 1365141 | A1 | 11/2003 |
| EP | 1083946 | B1 | 12/2003 |
| EP | 1078736 BI | | 1/2004 |

| | | | |
|---|---|---|---|
| EP | 1378271 | A1 | 1/2004 |
| EP | 0757615 | B1 | 3/2004 |
| EP | 0842754 | B1 | 3/2004 |
| EP | 1 411 145 | | 4/2004 |
| EP | 0862395 | B1 | 4/2004 |
| EP | 1 418 353 | A2 | 5/2004 |
| EP | 1440775 | A1 | 7/2004 |
| EP | 1445119 | A1 | 8/2004 |
| EP | 1475557 | A1 | 11/2004 |
| EP | 1481699 | A1 | 12/2004 |
| EP | 1482190 | A2 | 12/2004 |
| EP | 1498597 | A1 | 1/2005 |
| EP | 1 510 594 | A2 | 3/2005 |
| EP | 1311885 | B1 | 3/2005 |
| EP | 1512781 | A2 | 3/2005 |
| EP | 1183470 | B1 | 4/2005 |
| FR | 2 669 689 | | 5/1992 |
| GB | 768226 | | 2/1957 |
| GB | 1005638 | | 10/1988 |
| GB | 2338716 | | 12/1999 |
| IE | 0990532 | A1 | 3/2001 |
| JP | 62-111106 | | 5/1987 |
| JP | 63-21209 | A2 | 1/1988 |
| JP | 63-288994 | A2 | 11/1988 |
| JP | 5-70879 | | 3/1993 |
| JP | 5-36004 | | 5/1993 |
| JP | 5-42616 | | 6/1993 |
| JP | 6-264993 | | 9/1994 |
| JP | 6-294307 | A | 10/1994 |
| JP | 7-63135 | | 3/1995 |
| JP | 7-90553 | A | 4/1995 |
| JP | 7-103238 | | 4/1995 |
| JP | 07-118832 | | 5/1995 |
| JP | 7-41386 | A2 | 10/1995 |
| JP | 7-286696 | | 10/1995 |
| JP | 8-14014 | | 1/1996 |
| JP | 8-61499 | | 3/1996 |
| JP | 9-20981 | A2 | 1/1997 |
| JP | 52006318 | | 1/1997 |
| JP | 253770 | A2 | 9/1997 |
| JP | 10-088369 | A2 | 4/1998 |
| JP | 10-265790 | A | 10/1998 |
| JP | 10-298440 | A2 | 11/1998 |
| JP | 11-22423 | | 1/1999 |
| JP | 11-190406 | | 7/1999 |
| JP | 11-292629 | A2 | 10/1999 |
| JP | 11-294118 | | 10/1999 |
| JP | 11-333773 | A2 | 12/1999 |
| JP | 2000-88104 | | 3/2000 |
| JP | 2000-119843 | | 4/2000 |
| JP | 2000-504089 | | 4/2000 |
| JP | 2000297373 | | 10/2000 |
| JP | 2000-327484 | | 11/2000 |
| JP | 2000-339083 | | 12/2000 |
| JP | 2001-64005 | | 3/2001 |
| JP | 200162605 | | 3/2001 |
| JP | 2001-93141 | A2 | 4/2001 |
| JP | 2001-172766 | A2 | 6/2001 |
| JP | 2001-192864 | | 7/2001 |
| JP | 2001-280236 | A | 10/2001 |
| JP | 2001269938 | | 10/2001 |
| JP | 2002-265968 | A2 | 9/2002 |
| JP | 2002-309912 | | 10/2002 |
| JP | 2002-332571 | | 11/2002 |
| JP | 2003-13163 | | 1/2003 |
| JP | 2003-13799 | | 1/2003 |
| JP | 2003-25117 | | 1/2003 |
| JP | 2003-28174 | A2 | 1/2003 |
| JP | 2003-88939 | | 3/2003 |
| JP | 2003-113941 | | 4/2003 |
| JP | 2003-147508 | | 5/2003 |
| JP | 2004-36788 | A2 | 2/2004 |
| JP | 200568529 | A2 | 3/2004 |
| RU | 2004586 | C1 | 12/1993 |
| RU | 2153782 | | 7/2000 |
| SU | 1770350 | A1 | 10/1992 |
| WO | WO 89/06707 | A1 | 7/1989 |
| WO | WO 89/06708 | A1 | 7/1989 |
| WO | WO 8906338 | A1 | 7/1989 |
| WO | WO 92/02602 | | 2/1992 |
| WO | WO 9206843 | A1 | 4/1992 |
| WO | WO 9219425 | A2 | 11/1992 |
| WO | WO 93/21288 | | 10/1993 |
| WO | WO 93/21289 | | 10/1993 |
| WO | WO 9324828 | A1 | 12/1993 |
| WO | WO 95/20253 | A2 | 7/1995 |
| WO | WO 95/29044 | A1 | 11/1995 |
| WO | WO 95/29273 | A1 | 11/1995 |
| WO | WO 95/31584 | A1 | 11/1995 |
| WO | WO 96/04485 | | 2/1996 |
| WO | WO 96/05333 | A1 | 2/1996 |
| WO | WO 96/05942 | A1 | 2/1996 |
| WO | WO 96/06961 | A1 | 3/1996 |
| WO | WO 96/12389 | A1 | 4/1996 |
| WO | WO 96/24488 | A1 | 8/1996 |
| WO | WO 96/40446 | A1 | 12/1996 |
| WO | WO 97/07531 | A1 | 2/1997 |
| WO | WO 97/10093 | A1 | 3/1997 |
| WO | WO 97/10940 | A1 | 3/1997 |
| WO | WO 97/14555 | | 4/1997 |
| WO | WO 97/16138 | A1 | 5/1997 |
| WO | WO 98/02715 | A1 | 1/1998 |
| WO | WO 98/12994 | A1 | 4/1998 |
| WO | WO 98/135528 | A1 | 4/1998 |
| WO | WO 98/47141 | A1 | 10/1998 |
| WO | WO 99/09547 | A1 | 2/1999 |
| WO | WO 99/12404 | A1 | 3/1999 |
| WO | WO 99/14512 | A1 | 3/1999 |
| WO | WO 99/16371 | A1 | 4/1999 |
| WO | WO 99/22694 | A2 | 5/1999 |
| WO | WO 99/27157 | A1 | 6/1999 |
| WO | WO 99/29477 | A1 | 6/1999 |
| WO | WO 99/31557 | A1 | 6/1999 |
| WO | WO 99/34385 | A1 | 7/1999 |
| WO | WO 99/46847 | A1 | 9/1999 |
| WO | WO 99/54520 | A1 | 10/1999 |
| WO | WO 99/54934 | A1 | 10/1999 |
| WO | WO 99/57743 | A1 | 11/1999 |
| WO | WO 99/62077 | A1 | 12/1999 |
| WO | WO 99/62572 | A1 | 12/1999 |
| WO | WO 00/22613 | A1 | 4/2000 |
| WO | WO 00/24554 | A1 | 5/2000 |
| WO | WO 00/25410 | A1 | 5/2000 |
| WO | WO 00/28142 | A1 | 5/2000 |
| WO | WO 00/33051 | A1 | 6/2000 |
| WO | WO 00/35000 | A1 | 6/2000 |
| WO | WO 00/44032 | A1 | 7/2000 |
| WO | WO 00/47402 | A1 | 8/2000 |
| WO | WO 00/55385 | A1 | 9/2000 |
| WO | WO 00/56127 | A1 | 9/2000 |
| WO | WO 00/56393 | A1 | 9/2000 |
| WO | WO 00/62327 | A2 | 10/2000 |
| WO | WO 00/68451 | A2 | 11/2000 |
| WO | WO 00/75517 | A1 | 12/2000 |
| WO | WO 00/78504 | A1 | 12/2000 |
| WO | WO 01/05917 | | 1/2001 |
| WO | WO 01/006033 | A1 | 2/2001 |
| WO | WO 01/14736 | A1 | 3/2001 |
| WO | WO 01/14745 | A1 | 3/2001 |
| WO | WO 01/26862 | A1 | 4/2001 |
| WO | WO 01/37631 | A2 | 5/2001 |
| WO | WO 01/40537 | A1 | 6/2001 |
| WO | WO 01/47451 | A1 | 7/2001 |
| WO | WO 01/59544 | A2 | 8/2001 |
| WO | WO 01/61182 | | 8/2001 |
| WO | WO 01/61719 | A1 | 8/2001 |

| | | | |
|---|---|---|---|
| WO | WO 01/62372 | A1 | 8/2001 |
| WO | WO 01/63639 | A1 | 8/2001 |
| WO | WO 01/67834 | A1 | 9/2001 |
| WO | WO 01/79583 | A2 | 10/2001 |
| WO | WO 01/80224 | A2 | 10/2001 |
| WO | WO 02/006875 | A1 | 1/2002 |
| WO | WO 02/13188 | A1 | 2/2002 |
| WO | WO 02/24601 | A1 | 3/2002 |
| WO | WO 02/24603 | A1 | 3/2002 |
| WO | WO 02/24970 | A2 | 3/2002 |
| WO | WO 02/32625 | A2 | 4/2002 |
| WO | WO 02/44440 | A1 | 6/2002 |
| WO | WO 02/054454 | A2 | 7/2002 |
| WO | WO 02/062714 | A2 | 8/2002 |
| WO | WO 02/073021 | | 9/2002 |
| WO | WO 02/080996 | A1 | 10/2002 |
| WO | WO 02/085237 | A2 | 10/2002 |
| WO | WO 02/090461 | A1 | 11/2002 |
| WO | WO 02/097289 | A1 | 12/2002 |
| WO | WO 03/009978 | A1 | 2/2003 |
| WO | WO 03/013990 | A1 | 2/2003 |
| WO | WO 03/020329 | A1 | 3/2003 |
| WO | WO 03/021731 | A1 | 3/2003 |
| WO | WO 03/031543 | A2 | 4/2003 |
| WO | WO 2003/046508 | A3 | 6/2003 |
| WO | WO 03/054876 | A1 | 7/2003 |
| WO | WO 03/076309 | A2 | 9/2003 |
| WO | WO 03/078679 | A1 | 9/2003 |
| WO | WO 03/091758 | A2 | 11/2003 |
| WO | WO 2003/095009 | A1 | 11/2003 |
| WO | WO 03/105134 | A1 | 12/2003 |
| WO | WO 2004/001804 | A2 | 12/2003 |
| WO | WO 2004/004998 | A1 | 1/2004 |
| WO | WO 2004/019809 | A2 | 3/2004 |
| WO | WO 2004/024206 | A1 | 3/2004 |
| WO | WO 2004/026359 | A1 | 4/2004 |
| WO | WO 2004/026500 | A2 | 4/2004 |
| WO | WO 2004/036169 | A1 | 4/2004 |
| WO | WO 2004/036292 | A2 | 4/2004 |
| WO | WO 2004/038701 | A2 | 5/2004 |
| WO | WO 2004/043631 | A1 | 5/2004 |
| WO | WO 2004/048126 | A2 | 6/2004 |
| WO | WO 2004/067466 | A1 | 8/2004 |
| WO | WO 2004/068530 | A1 | 8/2004 |
| WO | WO 2004/071670 | A1 | 8/2004 |
| WO | WO 2004/072959 | A2 | 8/2004 |
| WO | WO 2004/078424 | A2 | 9/2004 |
| WO | WO 2004/084773 | A1 | 10/2004 |
| WO | WO 2004/088113 | A1 | 10/2004 |
| WO | WO 2005/010596 | A2 | 2/2005 |
| WO | WO 2005/011744 | A2 | 2/2005 |
| WO | WO 2005/014760 | A1 | 2/2005 |
| WO | WO 2005/014882 | A1 | 2/2005 |
| WO | WO 2005/016620 | A2 | 2/2005 |
| WO | WO 2005016620 | A2 | 2/2005 |
| WO | WO 2005/021851 | A1 | 3/2005 |
| WO | WO 2005/025844 | A1 | 3/2005 |
| WO | WO 2005/034791 | A1 | 4/2005 |
| WO | WO 2005/037144 | A2 | 4/2005 |
| WO | WO 2005/037985 | A2 | 4/2005 |
| WO | WO 2005/040451 | A1 | 5/2005 |
| WO | WO 2005/042064 | A1 | 5/2005 |
| WO | WO 2005/047737 | A1 | 5/2005 |

OTHER PUBLICATIONS

U.S. Appl. No. 10/468,713, filed Aug. 22, 2003, Mabuchi et al.
E. Mayer-Rässler, "Neuartige Laufflächen-Schutzverfahren für Kolben von Verbrennungsmotoren", VDI-Zeitschrift Bd., Apr. 18, 1942, vol. 86, No. 15-16, pp. 245-247.
Japanese Industrial Standard, "Surface roughness—Definitions and designation", JIS B 0601, 1994, pp. 1-25.
"Standard Test Method for Separation of Representative Aromatics and Nonaromatics Fractions of High-Boiling Oils by Elution Chromatography", ASTM Standards, Designation: D 2549—91 (Reapproved 1995), pp. 895-900.
International Standard, "Petroleum products—Determination of base number—Perchloric acid potentiometric titration method", ISO 3771, second edition Aug. 15, 1994, pp. 1-8.
Japanese Industrial Standard, "High carbon chromium bearing steels", JIS G 4805, 1999, pp. 1-31.
Steve J. Bull et al., "High-Performance Diamond and Diamond-like Coatings", JOM, Apr. 1995, pp. 16-19, vol. 47, No. 4, XP 000500980.
K. Holmberg, "Tribological Characteristics of Diamond-Like Carbon Coatings", VTT Manufacturing Technology, Jan. 1994, pp. 24-38, XP 000570636.
Gåhlin, Rickard et al., "ME-C:H Coatings in Motor Vehicles, " *WEAR* 249, 2001, pp. 302-309.
Hershberger, J., et al., "Evaluation of DLC Coatings for Spark-Ignited, Direct-Injected Fuel Systems," *Surface & Coatings Technology*, 179, 2004, pp. 237-244.
Hershberger, J. et al., "Friction and Wear Behavior of Near-Frichtionless Carbon Coatings in Formulated Gasolines," *Surface & Coating Technology*, 183, 2004, pp. 111-117.
Kovalchenko, A., et al., "Friction and Wear Performance of Low-Friction Carbon Coatings Under Oil Lubrication," Energy Technology Div., Argonne National Laboratory.
Ajayi, O., et al., "Effect of Carbon Coating on Scuffing Performance in Diesel Fuels," *Tribology Transactions*, vol. 44, 2001, pp. 298-304.
Ajayi, O., et al., Effect of Thin-Film Coating on Wear in EGR-Contaminated Oil, Energy Technology Div., Argonne National Laboratory.
Fujimori, N., et al., "Characterization of Conducting Diamond Films," *Vacuum*, vol. 36, Nos. 1-3, 1996, pp. 99-102.
Patent/Literature Search Report, Bawa Biotechology Consulting, LLC, Jun. 3, 2005, pp. (201 pages).
"Aluminium Alloy Die Castings," Japanese Industrial Standard (JIS H 5302), 2000, pp. 1-12.
"Aluminium Alloys Castings", Japanese Industrial Standard (JIS H 5202), 1999 (18 pages).
Japanese Industrial Standard, "Aluminium Alloy Castings", JIS H 5202, 1999, pp. 1910, 1911 and 1636-1647.
"Aluminum Alloy Die Castings," JIS H5302 (2000), pp. 1670-1681.
"Assessment of 2nd to 5th Order Irregularities of Surface Configuration by Means of Sections of Surfaces Definitions Relating to Reference System and Dimensions," DIN 4762, UDC 621-288:001.4 (Aug. 1960), pp. 1-4.
API Motor Oil Guide, Which Oil is Right for You, American Petroleum Institute, Copyright 2002.
"Carbon Steels for Machine Structural Use", Japanese Industrial Standard (JIS G 4051), 1979, pp. 1381-1383.
"Carbon Steels for Machine Structural Use", Japanese Industrial Standard (JIS G 4051), 1979, pp. 1-10.
"Chromium Molybdenum Steels," Japanese Industrial Standard (JIS G 4105), 1979, pp. 1-11 (with Translation).
"Chromium Steels," Japanese Industrial Standard (JIS G 4104), 1979, pp. 1-9.
D.G. Watson et al., "Engineering Drawing Practice," XP002281300, University of Hertfordshire, Sep. 1991, p. 29, Figure 38.
Database WPI, Nov. 28, 2000, Derwent Publications, Ltd., AN 2000640583, XP002240184, JP 2000-327484, Nov. 28, 2000.
Dr. Marx, "Surfaces and Contact Mechanics", XP-002233233, Google, Retrieved from the Internet, Mar. 3, 2003, pp. 1-18.
Engine Oil Viscosity Classification—SAE J300 revised Apr. 1997, p.133.
"Geometrical Product Specifications (GPS)—Surface Texture: Profile Method—Terms, Definitions and Surface Texture Parameters," International Standard, ISO 4287, TC 213 (1997), pp. 1-25.
"Geometrical Product Specifications (GPS)—Surface texture: Profile method—Terms, Definitions and surface texture parameters", Japanese Industrial Standard (JIS B 0601) Machine Elements, 2003, pp. 6, 7, 263-287, and 2586.

"Grey iron castings", Japanese Industrial Standard (JIS G 5501), pp. 2075-2077.
International Standard "Application of Carbides for Machining by Chip Removal—Designation of the Main Groups of Chip Removal and Groups of Application," ISO 513, (1975), pp. 67-69.
Japanese Industrial Standard, "Structural Steels with Specified Hardenability Bands", JIS G 4052, 1979, pp. 2414, 2415, 1390-1403, 1410 and 1411.
JIS Japanese Industrial Standard; "Vickers Hardness Test—Test Method"; JIS Z 2244; 1998; (w/Translation).
Japanese Industrial Standard, 2001, No. B 0601.
Kano et al., "Friction Characteristics of a Hard Carbon Film in Engine Oil, (No. 2) (Surface Analysis Result of Sliding Surface),"Japan Tribology Congress 1999, 5, pp. 11-12.
M. Kano et al., "The Effect of ZDDP and MODTC Additives on Friction Properties of DLC and Steel Cam Follower in Engine Oil", Abstracts of Papers from 2nd World Tribology Congress, Sep. 3-7, 2001, p. 342.
Patent Abstracts of Japan, vol. 1996, No. 09, Sep. 30, 1996, JP 08-128448, May 21, 1996.
Patent Abstracts of Japan, vol. 2000, No. 01, Jan. 31, 2000, JP 11-287, Oct. 19, 1999.
Patent Abstracts of Japan, vol. 2000, No. 09, Oct. 13, 2000, JP 2000-170768, Jun. 20, 2000.
PCT/IB2004/002552.
"Stainless Steel Bars", Japanese Industrial Standard (JIS G 4303), pp. 1457-1477.
"Standard Practice for Codification of Certain Nonferrous Metals and Alloys, Cast and Wrought1", ASTM International, Designation: B 275-02, Jun. 2002, pp. 1-7.
"Standard Test Method for Calibration and Operation of the Falex Block-on-Ring Friction and Wear Testing Machine", ASTM Designation: D2714—88, Jan. 1989, pp. 383-386.
Patent Abstracts of Japan, vol. 2003, No. 12, Dec.5, 2003, JP 2004-155891, Jun. 3, 2004.
Ronkainen, Helena, "Tribological Properties of Hydrogenated and Hydrogen-Free Diamond-Like Carbon Coatings," Disseration for the Degree of Doctor of Science in Technology, VTT Publications No. 434.

* cited by examiner

REFRIGERANT COMPRESSOR AND FRICTION CONTROL PROCESS THEREFOR

CROSS-REFERENCE TO RELATED APPLICATIONS

The present application is related to the following applications: U.S. patent application Ser. No. 09/545,181 (based on Japanese Patent Application No. 11-102205 filed on Apr. 9, 1999); U.S. patent application Ser. No. 10/468,713, which is the national phase of PCT Application No. JP02/10057 (based on Japanese Patent Application No. 2001-117680 filed on Apr. 17, 2001); U.S. patent application Ser. No. 10/355,099 (based on Japanese Patent Application 2002-45576 filed on Feb. 22, 2002); U.S. patent application Ser. No. 10/682,559 (based on Japanese Patent Application No. 2002-302205 filed on Oct. 16, 2002); and U.S. patent application Ser. No. 10/692,853 (based on Japanese Patent Application No. 2002-322322 filed on Oct. 16, 2002).

BACKGROUND OF THE INVENTION

The invention relates to a refrigerant compressor having compressor parts slidable relative to each other with a lower friction coefficient in the presence of a specific lubricant so as to reduce, when used in an automotive air conditioner, engine load during air conditioning and thereby improve engine fuel efficiency. The invention also relates to a process for controlling sliding friction between the compressor parts of the refrigerant compressor.

Refrigerant compressors for air conditioners and refrigerators are broadly divided into two broad categories: wobble-plate types (variable displacement types) and rotary-vane types. Each type of refrigerant compressor has a component part slidably held on a bearing or slidably contacted with any other iron-based part. These sliding parts are lubricated with a refrigeration oil. In general, the refrigeration oil contains therein a few percent of phosphorus-based extreme-pressure agent and alcohol friction modifier as disclosed in Japanese Laid-Open Patent Publication No. 10-265790.

SUMMARY OF THE INVENTION

Under such lubrication conditions, however, the sliding friction between the compressor parts is not reduced to a sufficient degree. There is a growing need to further reduce the sliding friction between the compressor parts so as to reduce engine load and improve fuel efficiency as the recent measures against global environmental problems.

It is therefore an object of the present invention to provide a refrigerant compressor having compressor parts slidably opposed to each other so as to attain a lower friction coefficient and higher seizure/wear resistance between the compressor parts and, e.g. when used in an automotive air conditioner, obtain improvements in engine fuel efficiency upon reduction of engine load. It is also an object of the present invention to provide a process for controlling sliding friction between the compressor parts of the refrigerant compressor.

As a result of extensive research, it has been found by the present inventors that an opposed pair of compressor parts shows excellent low-friction characteristics and durability in the presence of a specific lubricant when either or both of the opposed sliding parts are covered with thin coatings of hard carbon low in hydrogen content. The present invention is based on the above finding.

According to a first aspect of the invention, there is provided a refrigerant compressor, comprising: compressor parts having sliding portions slidable relative to each other; and a refrigeration oil applied to the sliding portions of the compressor parts, wherein at least one of the sliding portions of the compressor parts has a hard carbon coating formed with a hydrogen content of 20 atomic % or less.

According to a second aspect of the invention, there is provided a refrigerant compressor, comprising: compressor parts having sliding portions slidable relative to each other; and a lubricant predominantly composed of a hydroxyl group containing compound and applied to the sliding portions of the compressor parts.

According to a third aspect of the invention, there is provided a process for controlling sliding friction between compressor parts in a refrigerant compressor, the process comprising: covering at least one of opposed sliding portions of the compressor parts with a hard carbon coating, while adjusting a hydrogen content of the hard carbon coating to 20 atomic % or less; and applying a lubricant to a sliding interface between the sliding portions of the compressor parts.

The other objects and features of the invention will also become understood from the following description.

DESCRIPTION OF THE EMBODIMENTS

The present invention will be described below in detail. In the following description, all percentages (%) are by mass unless otherwise specified.

Figure 1A:
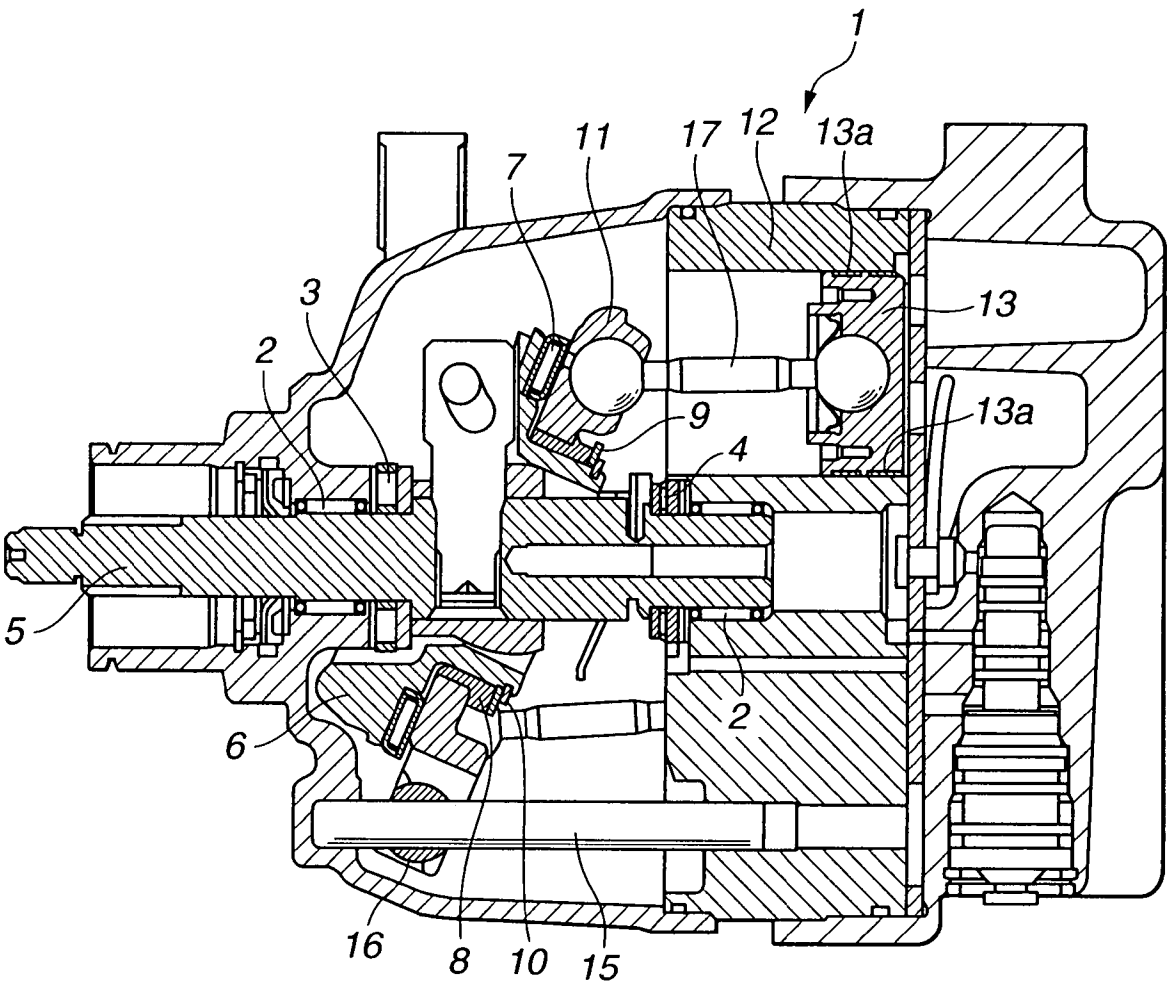
FIG. 1A is a sectional view of a refrigerant compressor according to one exemplary embodiment of the present invention.
Figure 1B:
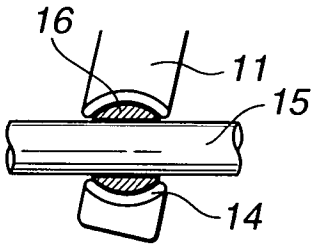
FIG. 1B is a schematic illustration showing the contact between a guide ball and a guide pin of the refrigerant compressor of FIG. 1A.

There is provided in a first embodiment of the present invention wobble-plate type (variable displacement type) refrigerant compressor 1 as shown in FIGS. 1A and 1B. Refrigerant compressor 1 includes front and rear main bearings 2, front thrust bearing 3, rear thrust bearing 4, drive shaft 5, journal 6, journal thrust bearing 7, sleeve bearing 8, journal thrust spacer 9, C-ring 10, socket plate (wobble plate) 11, cylinder 12, piston 13, shoe 14, guide pin 15, guide ball 16 and piston rod 17. Drive shaft 5 is supported by main bearings 2 and thrust bearings 3 and 4 so as to rotate together with journal 6. Socket plate 11 is supported by journal thrust bearing 7 and sleeve bearing 8 so as to rotate relative to journal 6, and is held with journal thrust spacer 9 and C-ring 10 so as not to fall off its position. Further, socket plate 11 is connected to piston 13 by piston rod 17. Piston 13 has piston ring 13*a* formed at an outer cylindrical face thereof, and reciprocates within cylinder 12 for intake, compression and exhaust strokes when socket plate 11 makes a reciprocating motion (but not a rotational motion) due to the rotation of drive shaft 5. Shoe 14 is made of sintered steel. Guide ball 16 is fitted in socket plate 11 with shoe 14 interposed between socket plate 11 and guide ball 16. Guide pin 15 is inserted through guide ball 16 such that guide pin 15 and guide ball 16 are slidable relative to each other upon the reciprocating motion of socket plate 11. For lubrication, a specific lubricant is supplied to the sliding interface between drive shaft 5 and main bearing 2, the sliding interface between driving shaft 5 and thrust bearing 3, 4, the sliding interface among journal 6, journal thrust bearing 7, sleeve bearing 8, journal thrust spacer 9 and C-ring 10, the sliding interface between piston ring 13*a* and a bore face of cylinder 12, the sliding interface between guide pin 15 and guide ball 16, the sliding interface between guide ball 16 and shoe 14 and the sliding interface between shoe 14 and socket plate 11.

Figure 1C:
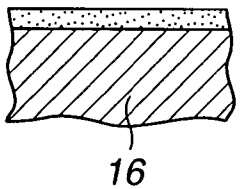
FIG. 1C is an enlarged sectional view of part of the guide ball of FIG. 1B.

At these sliding interfaces, at least one of any opposed sliding portions of refrigerant compressor 1 is covered with a thin coating of hard carbon low in hydrogen content. In the first embodiment, main bearings 2, thrust bearings 3 and 4, the bearing needle of journal thrust bearing 7, sleeve bearing 8, journal thrust spacer 9, C-ring 10, the bore face of cylinder 12, piston 13 with piston ring 13*a*, shoe 14 and guide ball 16 have their respective sliding portions covered with thin coatings of hard carbon low in hydrogen content. By way of example, the application of such a hard carbon coating to guide ball 16 is shown in FIG. 1C. The hard carbon coatings may alternatively be formed to cover the opposite sliding portions, such as the outer cylindrical face of drive shaft 5, the outer race faces of main bearings 2, the thrust race faces and spacer faces of thrust bearings 3 and 4, the face of journal 6 opposite sleeve bearing 8, the outer cylindrical face of guide pin 15 and the face of socket plate 11 opposite shoe 14, or formed to cover all of the above-mentioned sliding portions of refrigerant compressor 1. Also, hard carbon coatings may be applied to any other sliding portions, such as at least one of the opposed sliding portions of socket plate 11 and spherical end of piston rod 17.

Figure 2B:
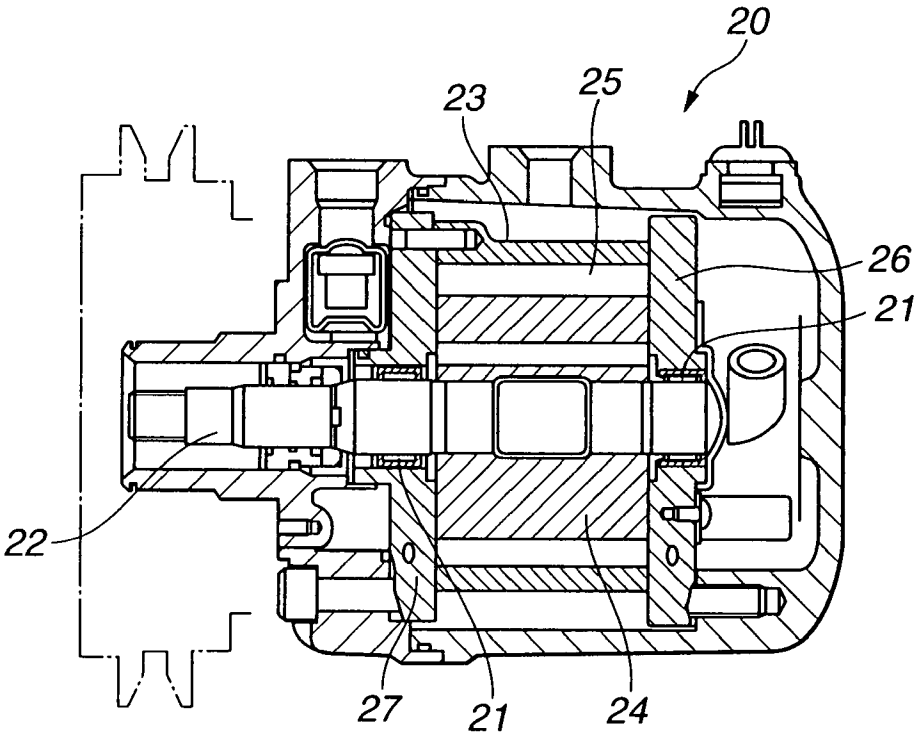
FIG. 2B is a vertical sectional view of the refrigerant compressor of FIG. 2A.
Figure 2A:
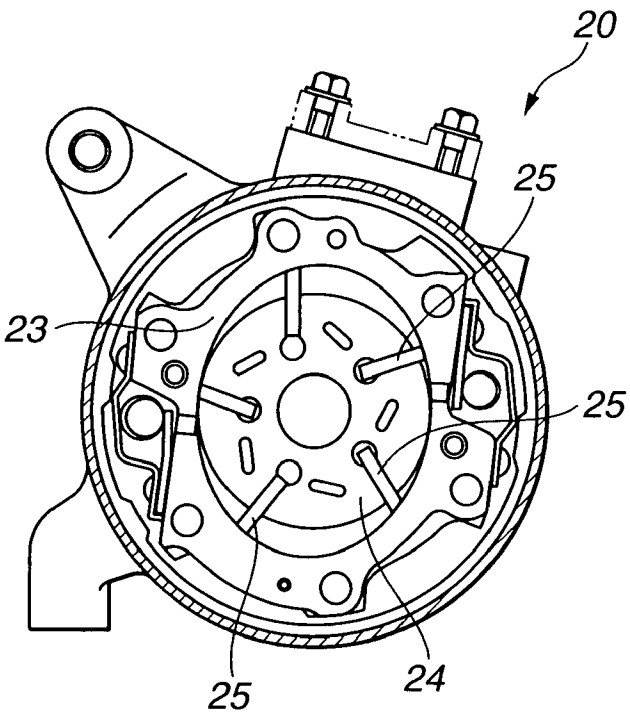
FIG. 2A is a transverse sectional view of a refrigerant compressor according to another exemplary embodiment of the present invention.

There is provided in a second embodiment of the present invention rotary-vane type refrigerant compressor 20 as shown in FIGS. 2A and 2B. Refrigerant compressor 20 includes two bearings 21, rotor shaft 22, elliptic ring 23, rotor 24, a plurality of vanes 25 and side plates 26 and 27. Rotor shaft 22 is rotatably supported by bearings 21. Rotor 24 is fixed to rotor shaft 22 such that rotor 24 rotates within ring 23. Vanes 25 are retractably attached to rotor 24 so as to have outer edges held in sliding contact with the inner cylindrical face of ring 23. Side plates 26 and 27 are disposed to close both open ends of ring 23, respectively. For lubrication, a specific lubricant is supplied to the sliding interface between bearing 21 and rotor shaft 22, the sliding interface among the outer cylindrical face of rotor 24, the outer edges of vanes 25 and the inner cylindrical face of ring 23, the sliding interface between rotor 24, both ends of vanes 25 and side plates 26 and 27 and the sliding interface between both faces of vanes 25 and vane grooves of rotor 24.

At these sliding interfaces, at least one of any opposed sliding portions of refrigerant compressor 20 is covered with a thin coating of hard carbon low in hydrogen content. In the second embodiment, the bearing needle of bearing 21, the inner cylindrical face of ring 23, both faces of vanes 25, the plate faces of side plates 26 and 27 opposite rotor 24 and vanes 25 have their respective sliding portions covered with thin coatings of hard carbon low in hydrogen content. The hard carbon coatings may alternatively be formed to cover the opposite sliding portions, such as the outer cylindrical face of rotor shaft 22, the outer race face of bearing 21, the outer edge and both ends of vanes 25, the outer cylindrical face, both ends and vane grooves of rotor 24, or formed to cover all of the above-mentioned sliding portions of refrigerant compressor 20.

With the hard carbon coatings applied to either or both of any opposed sliding portions of refrigerant compressor 1 or 20 as described above, it becomes possible to reduce sliding resistance and lower the coefficient of friction between any adjacent sliding compressor parts by the combined use of the specific lubricant.

In the first and second embodiments, the hard carbon coatings can be formed of a diamond-like carbon (DLC) material in which carbon exists in both $sp^2$ and $sp^3$ hybridizations to have a composite structure of graphite and diamond. Specific examples of the DLC material include hydrogen-free amorphous carbon (a-C), hydrogen-containing amorphous carbon (a-C:H) and/or metal carbide or metal carbon (MeC) that contains as a part a metal element of titanium (Ti) or molybdenum (Mo).

The coefficient of friction between any opposed sliding portions of refrigerant compressor 1 or 20 increases with the hydrogen content of the hard carbon coating. The hydrogen content of the hard carbon coatings is thus preferably adjusted to 20 atomic % or less, more preferably 10 atomic % or less, still more preferably 5 atomic % or less, and most preferably 0.5 atomic % or less, in order for the hard carbon coatings to provide a sufficiently low friction coefficient and stable sliding characteristics in the presence of the specific lubricant.

Such hard carbon coatings can be formed by a chemical vapor deposition process or a physical vapor deposition (PVD) process. In order to lower the hydrogen content of the hard carbon coating, it is desirable to form the hard carbon coatings by the PVD process, such as sputtering or ion plating, in which the coating atmosphere contains substantially no hydrogen and hydrogen-containing compounds. It may be further desirable to bake a reaction vessel and supporting fixtures and to clean the uncoated sliding portion, before the formation of the hard carbon coating, so as to lower the hydrogen content of the hard carbon coating effectively.

Further, the hard carbon coatings are fairly small in thickness and reflect the surface roughness of the sliding portions. The sliding portions are thus preferably finished to have a center line surface roughness Ra of 0.1 μm or lower in a condition that the sliding portions have not been yet covered with the hard carbon coatings. If the surface roughness Ra exceeds 0.1 μm, the surface roughness projections of the hard carbon coating increase a local contact pressure to the opposite sliding portion. This results in an increase of the occurrence of cracking in the hard carbon coatings. Herein, the surface roughness Ra is explained as $Ra_{75}$ according to JIS B0601.

As the lubricant, there may be used a refrigeration oil in the first and second embodiments.

The refrigeration oil is preferably prepared by blending a base oil with a friction modifier of oxygen-containing organic compound or compounds (hereinafter referred to as an "oxygen-containing organic friction modifier") in either of the first and second embodiments, so as to obtain a great friction reducing effect on the sliding friction between the hard-carbon coated sliding portion and the opposite sliding portion.

The base oil is not particularly limited, and can be selected from any commonly used lube base compounds, such as mineral oils, synthetic oils and mixtures thereof.

Specific examples of the mineral oils include normal paraffin oils and paraffin-based or naphthene-based oils prepared by extracting lubricating oil fractions from petroleum by atmospheric or reduced-pressure distillation, and then, purifying the obtained lubricating oil fractions with any of the following treatments: solvent deasphalting, solvent extraction, hydrocracking, solvent dewaxing, hydrorefining, solvent-refining, sulfuric acid treatment and clay refining. Although the lubricating oil fraction is generally purified by hydro- or solvent-refining, it may be preferable to purify the lubricating oil fraction by a deep hydrocracking process or a GTL (Gas-to-Liquids) wax isomerization process for reduction of an aromatics content in the base oil.

Specific examples of the synthetic oils include: poly-α-olefins (PAO), such as 1-octene oligomer, 1-decene oligomer and ethylene-propylene oligomer, and hydrogenated products thereof; isobutene oligomer and hydrogenated product thereof; isoparaffines; alkylbenzenes; alkylnaphthalenes; diesters, such as ditridecyl glutarate, dioctyl adipate, diisodecyl adipate, ditridecyl adipate and dioctyl sebacate; polyol esters, such as trimethylolpropane esters (e.g. trimethylolpropane caprylate, trimetylolpropane pelargonate and trimethylolpropane isostearate) and pentaerythritol esters (e.g. pentaerythritol-2-ethyl hexanoate and pentaerythritol pelargonate); polyoxyalkylene glycols; dialkyl diphenyl ethers; and polyphenyl ethers. Among others, preferred are poly-α-olefins, such as 1-octene oligomer and 1-decene oligomer, and hydrogenated products thereof.

These base oil compounds may be used alone or in combination thereof. In the case of using as the base oil a mixture of two or more base oil compounds, there is no particular limitation to the mixing ratio of the base oil compounds.

The sulfur content of the base oil is not particularly restricted, and is preferably 0.2% or less, more preferably 0.1% or less, still more preferably 0.05% or lower, based on the total mass of the base oil. It is specifically desirable to use the hydro-refined mineral oil or synthetic oil as the base oil, because the hydro-refined mineral oil and the synthetic oil each have a sulfur content of not more than 0.005% or substantially no sulfur content (not more than 5 ppm).

The aromatics content of the base oil is not also particularly restricted. Herein, the aromatics content is defined as the amount of an aromatics fraction determined according to ASTM D2549. In order for the refrigeration oil to maintain its lubrication properties suitably for use in refrigerant compressor 1 or 2 over an extended time period, the aromatic content of the base oil is preferably 15% or less, more preferably 10% or less, and still more preferably 5% or less, based on the total mass of the base oil. The refrigeration oil undesirably deteriorates in oxidation stability when the aromatics content of the base oil exceeds 15%.

The kinematic viscosity of the base oil is not particularly restricted. To use the refrigeration oil in refrigerant compressor 1 or 2, the kinematic viscosity of the base oil is preferably 2 $mm^2/s$ or higher, more preferably 3 $mm^2/s$ or higher, and at the same time, is preferably 20 $mm^2/s$ or lower, more preferably 10 $mm^2/s$ or lower, still more preferably 8 $mm^2/s$ or lower, as measured at 100° C. When the kinematic viscosity of the base oil is less than 2 $mm^2/s$ at 100° C., there is a possibility that the refrigeration oil fails to provide sufficient wear resistance and causes a considerable evaporation loss. When the kinematic viscosity of the base oil exceeds 20 $mm^2/s$ at 100° C., there is a possibility that the refrigeration oil fails to provide sufficient lubrication properties and deteriorates in low-temperature features.

In the case of using two or more base oil compounds in combination, it is not necessary to limit the kinematic viscosity of each base oil compound to within the above-specified range so for as the kinematic viscosity of the mixture of the base oil compounds at 100° C. is in the specified range.

The viscosity index of the base oil is not particularly restricted, and is preferably 80 or higher, more preferably 100 or higher, most preferably 120 or higher, to use the refrigeration oil in refrigerant compressor 1 or 2. When the base oil has a higher viscosity index, the refrigeration oil becomes less consumed and can attain good low-temperature viscosity feature.

The oxygen-containing organic friction modifier is preferably one or more compounds selected from the group consisting of: (a) alcohols; (b) carboxylic acids; (c) ethers; (d) esters; and (e) derivatives thereof.

As the alcohols (a), there may be used: (a.1)monohydric alcohols; (a.2)dihydric alcohols; (a.3)tri- or higher hydric alcohols; (a.4)alkylene oxide adducts thereof; and (a.5) mixtures thereof.

The monohydric alcohols (a.1) are those having one hydroxyl group in each molecule. Specific examples of the monohydric alcohols (a.1) are: $C_1$–$C_{40}$ monohydric alkyl alcohols (including all possible isomers), such as methanol, ethanol, propanols (1-propanol, 2-propanol), butanols (1-butanol, 2-butanol, 2-methyl-1-propanol, 2-methyl-2-propanol), pentanols (1-pentanol, 2-pentanol, 3-pentanol, 2-methyl-1-butanol, 3-methyl-1-butanol, 3-methyl-2-butanol, 2-methyl-2-butanol, 2,2-dimethyl-1-propanol), hexanols (1-hexanol, 2-hexanol, 3-hexanol, 2-methyl-1-pentanol, 2-methyl-2-pentanol, 2-methyl-3-pentanol, 3-methyl-1-pentanol, 3-methyl-2-pentanol, 3-methyl-3-pentanol, 4-methyl-1-pentanol, 4-methyl-2-pentanol, 2,3-dimethyl-1-butanol, 2,3-dimethyl-2-butanol, 3,3-dimethyl-1-butanol, 3,3-dimethyl-2-butanol, 2-ethyl-1-butanol, 2,2-dimethylbutanol), heptanols (1-heptanol, 2-heptanol, 3-heptanol, 2-methyl-1-hexanol, 2-methyl-2-hexanol, 2-methyl-3-hexanol, 5-methyl-2-hexanol, 3-ethyl-3-pentanol, 2,2-dimethyl-3-pentanol, 2,3-dimethyl-3-pentanol, 2,4-dimethyl-3-pentanol, 4,4-dimethyl-2-pentanol, 3-methyl-1-hexanol, 4-methyl-1-hexanol, 5-methyl-1-hexanol, 2-ethylpentanol), octanols (1-octanol, 2-octanol, 3-octanol, 4-methyl-3-heptanol, 6-methyl-2-heptanol, 2-ethyl-1-hexanol, 2-propyl-1-pentanol, 2,4,4-trimethyl-1-pentanol, 3,5-dimethyl-1-hexanol, 2-methyl-1-heptanol, 2,2-dimethyl-1-hexanol), nonanols (1-nonanol, 2-nonanol, 3,5,5-trimethyl-1-hexanol, 2,6-dimethyl-4-heptanol, 3-ethyl-2,2-dimethyl-3-pentanol, 5-methyloctanol etc.), decanols (1-decanol, 2-decanol, 4-decanol, 3,7-dimethyl-1-octanol, 2,4,6-trimethylheptanol, etc.), undecanols, dodecanols, tridecanols, tetradecanols, pentadecanols, hexadecanols, heptadecanols, octadecanols (stearyl alcohol, etc.), nonadecanols, eicosanols, and tetracosanols; $C_2$–$C_{40}$ monohydric alkenyl alcohols (including all possible isomers), such as ethenol, propenol, butenols, hexenols, octenols, decenols, dodecenols and octadecenols (oleyl alcohol, etc.); $C_3$–$C_{40}$ monohydric (alkyl)cycloalkyl alcohols (including all possible isomers), such as cyclopentanol, cyclohexanol, cycloheptanol, cyclooctanol, methylcyclopentanols, methylcyclohexanols, dimethylcyclohexanols, ethylcyclohexanols, propylcyclohexanols, butylcyclohexanols, cyclopentylmethanol, cyclohexylethanols (1-cyclohexylethanol, 2-cyclohexylethanol, etc.), cyclohexylpropanols (3-cyclohexylpropanol, etc.), cyclohexylbutanols (4-cyclohexylbuthanol, etc.) and butylcyclohexanol, 3,3,5, 5-tetramethylcyclohexanol; (alkyl)aryl alcohols (including all possible isomers), such as phenyl alcohol, methyl phenyl alcohols (o-cresol, m-cresol, p-cresol), creosols, ethyl phenyl alcohols, propyl phenyl alcohols, butyl phenyl alcohols, butyl methyl phenyl alcohols (3-methyl-6-tert-butylphenyl alcohol, etc.), dimethyl phenyl alcohols, diethyl phenyl alcohols, dibutyl phenyl alcohols (2,6-di-tert-butylphenyl alcohol, 2,4-di-tert-butylphenyl alcohol, etc.), dibutyl methyl phenyl alcohols (2,6-di-tert-butyl-4-metylphenyl alcohol, etc.), dibutyl ethyl phenyl alcohols (2,6-di-tert-butyl-4-ethylphenyl alcohol etc.), tributylphenyl alcohols (2,4,6-tri-tert-butylphenyl alcohol, etc.), naphthols (α-naphthol, β-naphthol), dibutyl naphthols (2,4-di-tert-butyl-α-naphthol, etc.); and triazines, such as 6-(4-oxy-3,5-di-tert-butyl-anilino)-2,4-bis-(n-octyl-thio)-1,3,5-triazine.

Of these monohydric alcohol compounds, preferred are low-volatile $C_{12}$–$C_{18}$ straight- or branched-chain alkyl or alkenyl alcohols, such as oleyl alcohol and stearyl alcohol, to obtain a greater friction reducing effect on the sliding friction between the hard-carbon coated sliding portion and the opposite sliding portion under high-temperature conditions.

The dihydric alcohols (a.2) are those having two hydroxyl groups in each molecule. Specific examples of the dihydric alcohols (a.2) are: $C_2$–$C_{40}$ alkyl or alkenyl diols (including all possible isomers), such as ethylene glycol, diethylene glycol, polyethylene glycols, propylene glycol, dipropylene glycol, polypropylene glycols, neopentyl glycol, 1,3-propanediol, 1,4-butanediol, 1,2-butanediol, 2-methyl-1,3-propanediol, 1,5-pentanediol, 1,6-hexanediol, 2-ethyl-2-methyl-1,3-propanediol, 2-methyl-2,4-pentanediol, 1,7-heptanediol, 2-methyl-2-propyl-1,3-propanediol, 2,2-diethyl-1,3-propanediol, 1,8-octanediol, 1,9-nonanediol, 2-butyl-2-ethyl-1,3-propanediol, 1,10-decanediol, 1,11-undecanediol, 1,12-dodecanediol, 1,13-tridecanediol, 1,14-tetradecanediol, 1,15-heptadecanediol, 1,16-hexadecanediol, 1,17-heptadecanediol, 1,18-octadecanediol, 1,19-nonadecanediol and 1,20-icosadecanediol; $C_2$–$C_{40}$ (alkyl)cycloalkanediols (including all possible isomers), such as cyclohexanediols and methylcyclohexanediols; $C_2$–$C_{40}$ dihydric (alkyl)arylalcohols (including all possible isomers), such as benzenediols (catechol, etc.), methylbenzenediols, ethylbenzenediols, butylbenzendiols (p-tert-butylcatechol, etc.), dibutylbenzenediols (4,6-di-tert-butylresorcin, etc.), 4,4'-thiobis(3-methyl-6-tert-butylphenol), 4,4'-butylidenebis(3-methyl-6-tert-butylphenol), 2,2'-methylenebis(4-methyl-6-tert-butylphenol), 2,2'-thiobis(4,6-di-tert-butylresorcine), 2,2'-methylenebis(4-ethyl-6-tert-butylphenol), 4,4'-methylenebis(2,6-di-tert-butylphenol), 2,2'-(3,5-di-tert-butyl-4-hydroxy)propane and 4,4'-cyclohexylidenebis(2,6-di-tert-butylphenol); condensation products of p-tert-butylphenol and formaldehyde; and condensation products of p-tert-butylphenol and acetoaldehyde.

Of these dyhydric alcohol compounds, preferred are ethylene glycol, propylene glycol, neopentyl glycol, 1,4-butanediol, 1,5-pentanediol, 1,6-hexanediol, 2-methyl-2,4-pentanediol, 2-ethyl-2-methyl-1,3-propanediol, 1,7-heptanediol, 1,8-octanediol, 1,9-nonanediol, 1,10-decanediol, 1,11-undecanediol and 1,12-dodecanediol, to obtain a greater friction reducing effect on the sliding friction between the hard-carbon coated sliding portion and the opposite sliding portion. Hindered alcohols having a high molecular weight of 300 or larger, desirably 400 or larger, such as 2,6-di-tert-butyl-4-(3,5-di-tert-butyl-4-hydroxylbenzyl)phenyl alcohol, are especially preferred to secure high oxidation resistance while obtaining a good friction reducing effect, as the high-molecular-weight hindered alcohols show high heat resistance and low volatility under high-temperature conditions (e.g. under sliding conditions in an internal combustion engine).

The tri- or higher hydric alcohols (a.3) are those having three or more hydroxyl groups in each molecule. In general, trihydric to decahydric alcohols, preferably trihydric to hexahydric alcohols, are used. Specific examples of the tri- or higher hydric alcohols (a.3) are glycerol; trimethylolalkanes such as trimethylolethane, trimethylolpropane and trimethylolbutane; erythritol; pentaerythritol; 1,2,4-butanetriol; 1,3,5-pentanetriol; 1,2,6-hexanetriol; 1,2,3,4-butanetetrol; sorbitol; adonitol; arabitol; xylitol; mannitol; and polymerization and condensation products thereof, such as a dimer, a trimer a tetramer, a pentamer, a hexamer, a heptamer and an octamer of glycerin (diglycerol, triglycerol, tetraglycerol, etc.), a dimer, a trimer a tetramer, a pentamer, a hexamer, a heptamer and an octamer of trimethylolpropane (ditrymethylolpropane, etc.), a dimer, a trimer a tetramer, a pentamer, a hexamer, a heptamer and an octamer of pentaerythritol (dipentaerythritol, etc.), solbitan and sorbitol/glycerin condensates (including intramolecular condensates, intermolecular condensates or self-condensates).

Alternatively, there may be used sugar alcohols, such as xylose, arabitol, ribose, rhamnose, glucose, fructose, galactose, mannose, sorbose, cellobiose, mantose, isomaltose, trehalose and saccharose.

Of these tri- or higher hydric alcohol compounds, preferred are trihydric to hexahydric alcohols, such as glycerin, trimethylolalkanes (trimethylolethane, trimethylolpropane, trimethylolbutane etc.), pentaerythritol, 1,2,4-butanetriol, 1,3,5-pentanetriol, 1,2,6-hexanetriol, 1,2,3,4-butanetetrol, sorbitol, sorbitan, sorbitol/glycerin condensates, adonitol, arabitol, xylitol, mannitol and mixtures thereof. Any of glycerin, trimethylolethane, trimethylolpropane, pentaerythritol, solbitan and mixtures thereof, especially trihydric to hexahydric hydric alcohols having an oxygen content of 20% or higher, desirably 30% or higher, more desirably 40% or higher, are more preferred. It should be noted that hepta- or higher hydric alcohols tend to become too high in viscosity.

The alkylene oxide adducts (a.4) are addition products of alkylene oxides to the mono- or polyhydric alcohols (a.1), (a.2) or (a.3). Specific examples of the alkylene oxide adducts (a.4) are those prepared by adding $C_2$–$C_6$ alkylene oxides, preferably $C_2$–$C_4$ alkylene oxides, or polymers (or copolymers) thereof to the alcohols to thereby hydrocarbyletherify or hydrocarbylesterify the hydroxyl groups of the alcohols. As the $C_2$–$C_6$ alkylene oxides, there may be used ethylene oxide, propylene oxide, 1,2-epoxybutane α-butylene oxide), 2,3-epoxybutane (β-butylene oxide), 1,2-epoxy-1-methylpropane, 1,2-epoxyheptane, 1,2-epoxyhexane. Among others, ethylene oxide, propylene oxide and/or butylene oxide, especially ethylene oxide and/or propylene oxide, are more preferred to obtain a greater friction reducing effect.

In the case of adding two or more different kinds of alkylene oxides, the polymerization process of oxyalkylene groups is not specifically restricted. The oxyalkylene groups may be random-copolymerized or block-copolymerized. When the alkylene oxide is added to any polyalcohol having 2 to 6 hydroxyl groups, the alkylene oxide may be added to a part or all of the hydroxyl groups of the polyalcohol.

As the carboxylic acids (b), there may be used: (b.1) aliphatic monocarboxylic acids (fatty acids); (b.2) aliphatic polycarboxylic acids; (b.3) carbocyclic carboxylic acids; (b.4)heterocyclic carboxylic acids; and (b.5) mixtures thereof.

The aliphatic monocarboxylic acids (b.1) are those having one carboxyl group in each molecule. Specific examples of the aliphatic monocarboxylic acids (b.1) are: $C_1$–$C_{40}$ saturated aliphatic monocarboxylic acids (including all possible isomers), such as methanoic acid, ethanoic acid (acetic acid), propanoic acid (propionic acid), butanoic acids (butyric acid, isobutyric acid, etc.), pentanoic acids (valeric acid, isovaleric acid, pivalic acid, etc.), hexanoic acids (caproic acid, etc.), heptanoic acids, octanoic acids (caprylic acid, etc.), nonanoic acids (pelargonic acid, etc.), decanoic acids, undecanoic acids, dodecanoic acids (lauric acid, etc.), tridecanoic acids, tetradecanoic acids (myristic acid, etc.), pentadecanoic acids, hexadecanoic acids (palmitic acid, etc.), heptadecanoic acids, octadecanoic acids (stearic acid, etc.), nonadecanoic acids, eicosanoic acids, heneicosanoic acids, docosanoic acids, tricosanoic acids, tetracosanoic acids, pentacosanoic acids, hexacosanoic acids, heptacosanoic acids, octacosanoic acids, nonacosanoic acids, and triacontanioic acids; and $C_1$–$C_{40}$ unsaturated aliphatic monocarboxylic acids (including all possible isomers), such as propenoic acids (acrylic acid, etc.), propynoic acids (propiolic acid, etc.), butenoic acids (methacrylic acid, crotonic acid, isocrotonic acid, etc.), pentenoic acids, hexenoic acids, heptenoic acids, octenoic acids, nonenoic acids, decenoic acids, undecenoic acids, dodecenoic acids, tridecenoic acids, tetradecenoic acids, pentadecenoic acids, hexadecenoic acids, heptadecenoic acids, octadecenoic acids (oleic acid, etc.), nonadecenoic acids, eicosenoic acids, heneicosenoic acids, docosenoic acids, tricosenoic acids, tetracosenoic acids, pentacosenoic acids, hexacosenoic acids, heptacosenoic acids, octacosenoic acids, nonacosenoic acids, and triacontenoic acids.

The aliphatic polycarboxylic acids (b.2) are those having two or more carboxyl groups in each molecule. Specific examples of the aliphatic polycarboxylic acids (b.2) are: $C_2$–$C_{40}$ saturated or unsaturated aliphatic dicarboxylic acids (including all possible isomers), such as ethanedioic acid (oxalic acid), propanedioic acids (malonic acid, etc.), butanedioic acids (succinic acid, methylmalonic acid, etc.), pentanedioic acids (glutaric acid, ethylmalonic acid, etc.), hexanedioic acids (adipic acid, etc.), heptanedioic acids (pimelic acid, etc.), octanedioic acids (suberic acid, etc.), nonanedioic acids (azelaic acid, etc.), decanedioic acids (sebacic acid, etc.), propenedioic acid, butenedioic acids (maleic acid, fumaric acid, etc.), pentenedioic acids (citraconic acid, mesaconic acid, etc.), hexenedioic acids, heptenedioic acids, octenedioic acids, nonenedioic acids, and decenedioic acids; saturated or unsaturated tricarboxylic acids (including all possible isomers), such as propanetricarboxylic acid, butanetricarboxylic acid, pentanetricarboxylic acid, hexanetricarboxylic acid, heptanetricarboxylic acid, octanetricarboxylic acid, nonanetricarboxylic acid, and decanetricarboxylic acid; and saturated or unsaturated tetracarboxylic acids (including all possible isomers).

The carbocyclic carboxylic acids (b.3) are those having one or more carboxyl groups in the carbocyclic structure. Specific examples of the carbocyclic carboxylic acids (b.3) are: $C_3$–$C_{40}$ naphthene mono-, di-, tri- or tetracarboxylic acids (including all possible isomers), such as cyclohexane monocarboxylic acid, methylcyclolhexane monocarboxylic acid, ethylcyclohexane monocarboxylic acid, propylcyclohexane monocarboxylic acid, butylcyclohexane monocarboxylic acid, pentylcyclohexane monocarboxylic acid, hexylcyclohexane monocarboxylic acid, heptylcyclohexane monocarboxylic acid, octylcyclohexane monocarboxylic acid, cycloheptane monocarboxylic acid, cyclooctane monocarboxylic acid, and trimethylcyclopentane dicarboxylic acid (camphor acid, etc.); $C_7$–$C_{40}$ aromatic monocarboxylic acids (including all possible isomers), such as benzenecarboxylic acid (benzoic acid), methylbenzenecarboxylic acids (toluic acid, etc.), ethylbenzenecarboxylic acids, propylbenzenecarboxylic acids, benzenedicarboxylic acids (phthalic acid, isophthalic acid, terephthalic acid, etc.), benzenetricarboxylic acids (trimellitic acid, etc.), benzeneteracarboxylic acids (pyromellitic acid, etc.), naphthalenecarboxylic acids (naphthoic acid, etc.); and $C_7$–$C_{40}$ aryl mono-, di-, tri- or tetracarboxylic acids (including all possible isomers), such as phenylpropanoic acid (hydroatropic acid), phenylpropenoic acids (atropic acid, cinnamic acid, etc.), salicylic acid, and alkylsalicylic acid having one or more $C_1$–$C_{30}$ alkyl substituent groups.

The heterocyclic carboxylic acids (b.4) are those having one or more carboxyl groups in the heterocylic structure. Specific examples of the heterocyclic carboxylic acids (b.4) are $C_5$–$C_{40}$ heterocyclic carboxylic compounds, such as furanecarboxylic acid, thiophenecarboxylic acid, and pyridinecarboxylic acid (nicotinic acid, isonicotinic acid, etc.).

As the ethers (c), there may be used: (c.1) saturated or unsaturated aliphatic ethers; (c.2) aromatic ethers; (c.3) cyclic ethers; and (c.4) mixtures thereof.

Specific examples of the aliphatic ethers (c.1) are: $C_1$–$C_{40}$ saturated or unsaturated aliphatic monoether compounds (including all possible isomers), such as dimethyl ether, diethyl ether, di-n-propyl ether; diisopropyl ether, dibutyl ether, diisobutyl ether, di-n-amyl ether, diisoamyl ether, dihexyl ether, diheptyl ether, dioctyl ether, dinonyl ether, didecyl ether, diundecyl ether, didodecyl ether, ditridecyl ether, ditetradecyl ether, dipentadecyl ether, dihexadecyl ether, diheptadecyl ether, dioctadecyl ether, dinonadecyl ether, dieicosyl ether, methyl ethyl ether, methyl n-propyl ether, methyl isopropyl ether, methyl isobutyl ether, methyl tert-butyl ether, methyl n-amyl ether, methyl isoamyl ether, ethyl n-propyl ether, ethyl isopropyl ether, ethyl isobutyl ether, ethyl tert-butyl ether, ethyl n-amyl ether, ethyl isoamyl ether, divinyl ether, diallyl ether, methyl vinyl ether, methyl allyl ether, ethyl vinyl ether, ethyl allyl ether.

Specific examples of the aromatic ethers (c.2) are: anisole; phenetole; phenyl ether; benzyl ether; phenyl benzyl ether; α-naphthyl ether; β-naphthyl ether; polyphenyl ether; and perfluoroether. These aromatic ether compounds may have one or more saturated or unsaturated, liner or branched aliphatic substituent groups at any positions, and are preferably in liquid form under normal usage conditions, especially at room temperatures.

Specific examples of the cyclic ethers (c.3) are: $C_2$–$C_{40}$ cyclic ether compounds, such as ethylene oxide, propylene oxide, trimethylene oxide, tetrahydrofuran, tetrahydropyran, and dioxane, glycidyl ether. These cyclic ether compounds may have one or more substituents, selected from the groups consisting of saturated or unsaturated linear or branched aliphatic groups, carbocyclic groups and saturated or unsaturated linear or branched aliphatic carbocyclic groups, at any positions.

As the esters (d), there may be used: (d.1)esters of aliphatic monocarboxylic acids (fatty acids); (d.2)esters of aliphatic polycarboxylic acids; (d.3)esters of carbocyclic carboxylic acids; (d.4)esters of heterocyclic carboxylic acids; (d.5)alkylene oxide adducts of alcohols or esters; and (d.6) mixtures thereof. These esters (d.1) to (d.5) may be complete esters in which all of the hydroxyl or carboxyl groups are esterified, or partial esters in which part of the hydroxyl or carboxyl groups remains without being esterified.

The aliphatic monocarboxylic acid esters (d.1) are esters of one or more of the aliphatic monocarboxylic acids (b.1) and one or more of the mono-, or polyhydric alcohols (a.1) to (a.3). Specific examples of the aliphatic monocarboxylic acid esters (d.1) are fatty acid esters having $C_6$–$C_{30}$ straight or branched hydrocarbon chains (preferably $C_8$–$C_{24}$ straight or branched hydrocarbon chains, more preferably $C_{10}$–$C_{20}$ straight or branched hydrocarbon chains), e.g., esters of one or more kinds of fatty acids (aliphatic monocarboxylic acids) having $C_6$–$C_{30}$ hydrocarbon chains and one or more kinds of aliphatic mono- or polyhydric alcohols, such as glycerin monooleate, glycerin dioleate, sorbitan monooleate, and sorbitan dioleate. These fatty acid esters are classified as ashless fatty ester friction modifiers.

The aliphatic monocarboxylic acid esters (d.1) other than the fatty ester friction modifiers include fatty acid esters having $C_1$–$C_5$ or $C_{31}$–$C_{40}$ linear or branched hydrocarbon groups, e.g., esters of one or more kinds of fatty acids (aliphatic monocarboxylic acids) having $C_1$–$C_5$ or $C_{31}$–$C_{40}$ hydrocarbon groups and one or more kinds of aliphatic mono- or polyhydric alcohols. Of these fatty acid esters, those having a kinematic viscosity of 1 to 100 $mm^2$/sec at 100° C. may be used for the base oil, and are generally differentiated from the fatty ester friction modifiers. Specific examples of the fatty acid esters differentiated from the fatty ester friction modifiers are: polyol esters (single esters, complex esters) prepared by reacting $C_3$–$C_{40}$ tri- or higher polyols (preferably $C_4$–$C_{18}$ tri- or higher polyols, more preferably $C_4$–$C_{12}$ tri- or higher polyols), especially of the kind having a neopentyl structure, with one or more selected from $C_1$–$C_{40}$ monocarboxylic acids (preferably $C_4$–$C_{18}$ monocarboxylic acids, more preferably $C_6$–$C_{12}$ monocarboxylic acids), such as trimethylolpropane caprylate, trimethylolpropane pelargonate, pentaerythritol 2-ethylhexanoate, and pentaerythritol pelargonate; mixtures thereof; and alkylene oxide adducts thereof. These fatty acid esters may be complete esters in which all of the hydroxyl or carboxyl groups are esterified, or partial esters in which part of the hydroxyl or carboxyl groups remains without being esterified, and are however preferably complete esters. In order for the fatty acid esters to be suitably used for the base oil, the fatty acid esters have a hydroxyl value of generally 100 mg KOH/g or less, preferably 50 mg KOH/g or less, more preferably 10 mg KOH/g or less, and a kinematic viscosity of preferably 2 to 60 $mm^2$/sec, more preferably from 3 to 50 $mm^2$/sec, as measured at 100° C.

The aliphatic polycarboxylic acid esters (d.2) are esters of one or more of the aliphatic polycarboxylic acids (b.2) and one or more of the mono-, or polyhydric alcohols (a.1) to (a.3). Specific examples of the aliphatic polycarboxylic acid esters (d.2) are: diesters of one or more kinds of $C_2$–$C_{40}$ dicarboxylic acids (preferably $C_4$–$C_{18}$ dicarboxylic acids, more preferably $C_6$–$C_{12}$ dicarboxylic acids) and one or more kinds of $C_4$–$C_{40}$ monohydric alcohols (preferably $C_4$–$C_{18}$ monohydric alchols, more preferably $C_6$–$C_{14}$ monohydric alcohols), such as dibutyl maleate, ditridecyl glutamate, di-2-ethylhexyl adipate, diisodecyl adipate, ditridecyl adipate, and di-2-ethylhexyl sebacate; copolymers of the diesters (e.g., dibutyl maleate) and $C_4$–$C_{16}$ poly-α-olefins; and esters of $C_1$–$C_{40}$ alcohols and adducts of α-olefin to acetic anhydride or the like. Of these aliphatic polycarboxylic acid ester compounds, those having a kinematic viscosity of 1 to 100 $mm^2$/sec at 100° C. may be used for the base oil.

The carbocyclic carboxylic acid ester (d.3) are esters of one or more of the carbocyclic carboxylic acids (b.3) and one or more of the mono-, or polyhydric alcohols (a.1) to (a.3). Specific examples of the carbocyclic carboxylic acid esters (d.3) are aromatic carboxylates, such as phthalates, trimellitates, pyromellitates, salicylates. Of these carbocyclic carboxylic acid ester compounds, those having a kinematic viscosity of 1 to 100 $mm^2$/sec at 100° C. may be used for the base oil.

The heterocyclic carboxylic acid esters (d.4) are esters of one or more of the heterocyclic carboxylic acids (b.4) and one or more of the mono-, or polyhydric alcohols (a.1) to (a.3). Of these heterocyclic carboxylic acid ester compounds, those having a kinematic viscosity of 1 to 100 $mm^2$/sec at 100° C. may be used for the base oil.

The alkylene oxide adducts (d.5) include esters prepared by adding an alkylene oxide to one or more of the mono-, or polyhydric alcohols (a.1) to (a.3), followed by esterifying the thus-obtained addition products; and adducts of an alkylene oxide to any of the aliphatic monocarboxylic acid esters (d.1), the aliphatic polycarboxylic acid esters (d.2), the carbocyclic carboxylic acid esters (d.3) and the heterocyclic carboxylic acid esters (d.4). Of these alkylene oxide adducts, those having a kinematic viscosity of 1 to 100 $mm^2$/sec at 100° C. may be used for the base oil.

Specific examples of the oxygen-containing organic compound derivatives (e) are: those prepared by sulfidizing any one selected from the oxygen-containing organic compounds (a), (b), (c) and (d); those prepared by halogenating (fluorinating, chlorinating) any one selected from the oxygen-containing organic compounds (a), (b), (c) and (d); reaction products prepared by reacting any of the oxygen-containing organic compounds (a), (b), (c) and (d) with acids (such as sulfuric acid, nitric acid, boric acid and phosphoric acid), esters thereof or metal salts thereof; and reaction products prepared by reacting any of the oxygen-containing organic compounds (a), (b), (c) and (d) with metals, metal-containing compounds or amine compounds.

Of these derivatives, preferred are reaction products of one or more of the alcohols (a), carboxylic acids (b) and derivatives thereof with amine compounds (e.g., Mannich reaction products, acylated products, amides). As the amine compounds, there may be used: ammonia, monoamines, diamines and polyamines. Specific examples of the amine compounds are: ammonia; $C_1$–$C_{30}$ alkylamines (including all possible isomers), such as methylamine, ethylamine, propylamine, butylamine, pentylamine, hexylamine, heptylamine, octylamine, nonylamine, decylamine, undecylamine, dodecylamine, tridecylamine, tetradecylamine, pentadecylamine, hexadecylamine, heptadecylamine, octadecylamine, stearylamine, dimethylamine, diethylamine, dipropylamine, dibutylamine, dipentylamine, dihexylamine, diheptylamine, dioctylamine, dinonylamine, didecylamine, diundecylamine, didodecylamine, ditridecylamine, ditetradecylamine, dipentadecylamine, dihexadecylamine, diheptadecylamine, dioctadecylamine, methylethylamine, methylpropylamine, methylbutylamine, ethylpropylamine, ethylbutylamine, and propylbutylamine; $C_2$–$C_{30}$ alkenylamines (including all possible isomers), such as ethenylamine, propenylamine, buteniylamine, octenylamine, and oleylamine; $C_1$–$C_{30}$ alkanolamines (including all possible isomers), such as methanolamine, ethanolamine, propanolamine, butanolamine, pentanolamine, hexanolamine, heptaniolamine, octanolamine, nonanolamine, methanolethanolamine, methanolpropanolamine, methanolbutanolamine, ethanolpropanolamine, ethanolbutanolamine, and propanolbutanolamine; $C_1$–$C_{30}$ alkylenediamines, such as methylenediamine, ethylenediamine, propylenediamine, and butyleniediamine; polyamines, such as diethylenetriamine, triethylenetetramine, tetraethylenepentamine, pentaethylenehexamine; compounds derived from the monoamines, diamines or polyamines and further having $C_8$–$C_{20}$ alkyl or alkenyl group, such as undecyldiethylamine, undecyldiethanolamine, dodecyldipropanolamine, oleyldiethanolamine, oleylpropylenediamine, and stearyltetraethylenepentamine; heterocyclic compounds, such as N-hydroxyethyloleylimidazoline; alkylene oxide adducts thereof; and mixtures thereof. Of these nitrogen-containing compounds, preferred are aliphatic amines having $C_{10}$–$C_{20}$ alkyl or alkenyl groups (including all possible isomers), such as decylamine, dodecylamine, tridecylamine, heptadecylamine, octadecylamine, oleylamine and stearylamine.

More specifically, $C_8$–$C_{20}$ carbonamides, such as oleamide, are preferred as the oxygen-containing compound derivatives (e).

The amount of the oxygen-containing organic friction modifier added in the refrigeration oil is preferably 0.05 to 3.0%, more preferably 0.1 to 2.0%, still more preferably 0.5 to 1.4%, based on the total mass of the refrigeration oil. When the amount of the oxygen-containing organic friction modifier in the refrigeration oil is less than 0.05%, there arise a possibility of failing to attain a sufficient friction reducing effect. When the amount of the oxygen-containing organic friction modifier in the refrigeration oil exceeds 3.0%, the solubility of the oxygen-containing organic friction modifier in the refrigeration oil becomes so low that the refrigeration oil deteriorates in storage stability to cause precipitations.

The refrigeration oil may preferably include polybutenyl succinimide and/or derivative thereof.

As the polybutenyl succinimide, there may be used compounds represented by the following general formulas (1) and (2).

(1)

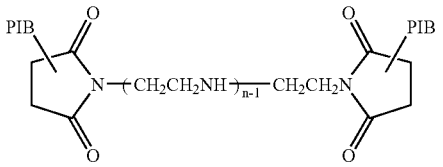

(2)

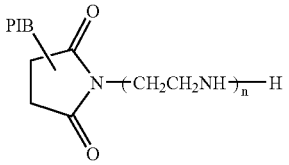

In the formulas (1) and (2), PIB represents a polybutenyl group derived from polybutene having a number-average molecular weight of 900 to 3500, preferably 1000 to 2000, that can be prepared by polymerizing high-purity isobutene or a mixture of 1-butene and isobutene in the presence of a boron fluoride catalyst or aluminum chloride catalyst. When the number-average molecular weight of the polybutene is less than 900, there is a possibility of failing to provide a sufficient detergent effect. When the number-average molecular weight of the polybutene exceeds 3500, the polybutenyl succinimide tends to deteriorate in low-temperature fluidity. The polybutene may be purified, before used for the production of the polybutenyl succinimide, by removing trace amounts of fluorine and chlorine residues resulting from the above polybutene production catalyst with any suitable treatment (such as adsorption process or washing process) in such a way as to control the amount of the fluorine and chlorine residues in the polybutene to 50 ppm or less, desirably 10 ppm or less, more desirably 1 ppm or less.

Further, n represents an integer of 1 to 5, preferably 2 to 4, in the formulas (1) and (2) in the formulas (1) and (2) in view of the detergent effect.

The production method of the polybutenyl succinimide is not particularly restricted. For example, the polybutenyl succinimide can be prepared by reacting a chloride of the polybutene, or the polybutene from which fluorine and chlorine residues are sufficiently removed, with maleic anhydride at 100 to 200° C. to form polybutenyl succinate, and then, reacting the thus-formed polybutenyl succinate with polyamine (such as diethylene triamine, triethylene tetramine, tetraethylene pentamine or pentaethylene hexamine).

As the polybutenyl succinimide derivative, there may be used boron- or acid-modified compounds obtained by reacting the polybutenyl succinimides of the formula (1) or (2) with boron compounds or oxygen-containing organic compounds so as to neutralize or amidate the whole or part of the remaining amino and/or imide groups. Among others, boron-containing polybutenyl succinimides, especially boron-containing bis(polybutenyl)succinimide, are preferred. The content ratio of nitrogen to boron (B/N) by mass in the boron-containing polybutenyl succinimide compound is usually 0.1 to 3, preferably 0.2 to 1.

The boron compound used for producing the polybutenyl succinimide derivative can be a boric acid, a borate or a boric acid ester. Specific examples of the boric acid include orthoboric acid, metaboric acid and tetraboric acid. Specific examples of the borate include: ammonium salts, such as ammonium borates, e.g., ammonium metaborate, ammonium tetraborate, ammonium pentaborate and ammonium octaborate. Specific examples of the boric acid ester include: esters of boric acids and alkylalcohols (preferably $C_1$–$C_6$ alkylalcohols), such as monomethyl borate, dimethyl borate, trimethyl borate, monoethyl borate, diethyl borate, triethyl borate, monopropyl borate, dipropyl borate, tripropyl borate, monobutyl borate, dibutyl borate and tributyl borate.

The oxygen-containing organic compound used for producing the polybutenyl succinimide derivative can be any of $C_1$–$C_{30}$ monocarboxylic acids, such as formic acid, acetic acid, glycolic acid, propionic acid, lactic acid, butyric acid, valeric acid, caproic acid, enanthic acid, caprylic acid, pelargonic acid, capric acid, undecylic acid, lauric acid, tridecanoic acid, myristic acid, pentadecanoic acid, palmitic acid, margaric acid, stearic acid, oleic acid, nonadecanoic acid and eicosanoic acid; $C_2$–$C_{30}$ polycarboxylic acids, such as oxalic acid, phthalic acid, trimellitic acid and pyromellitic acid, and anhydrides and esters thereof; $C_2$–$C_6$ alkylene oxides; and hydroxy(poly)oxyalkylene carbonates.

The amount of the polybutenyl succinimide and/or polybutenyl succinimide derivative contained in the refrigeration oil is not particularly restricted, and is preferably 0.1 to 15%, more preferably 1.0 to 12%, based on the total mass of the refrigeration oil. When the amount of the polybutenyl succineimide and/or polybutenyl succinimide derivative in the refrigeration oil is less than 0.1%, there is a possibility of failing to attain a sufficient detergent effect. When the amount of the polybutenyl succineimide and/or polybutenyl succinimide derivative in the refrigeration oil exceeds 15%, the refrigeration oil may deteriorate in demulsification ability. In addition, it is uneconomical to add such a large amount of the polybutenyl succineimide and/or polybutenyl succinimide derivative in the refrigeration oil.

Further, the refrigeration oil may preferably include zinc dithiophosphate.

As the zinc dithiophosphate, there may be used compounds represented by the following general formula (3).

(3)

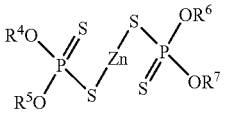

In the formula (3), $R^4$, $R^5$, $R^6$ and $R^7$ each represent $C_1$–$C_{24}$ hydrocarbon groups. The $C_1$–$C_{24}$ hydrocarbon group is preferably a $C_1$–$C_{24}$ straight- or branched-chain alkyl group, a $C_3$–$C_{24}$ straight- or branched-chain alkenyl group, a $C_5$–$C_{13}$ cycloalkyl or straight- or branched-chain alkylcycloalkyl group, a $C_6$–$C_{18}$ aryl or straight- or branched-chain alkylaryl group, or a $C_7$–$C_{19}$ arylalkyl group. The above alkyl group or alkenyl group can be primary, secondary or tertiary. Specific examples of $R^4$, $R^5$, $R^6$ and $R^7$ include: alkyl groups, such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl and tetracosyl; alkenyl groups, such as propenyl, isopropenyl, butenyl, butadienyl, pentenyl, hexenyl, heptenyl, octenyl, nonenyl, decenyl, undecenyl, dodecenyl, tridecenyl, tetradecenyl, pentadecenyl, hexadecenyl, heptadecenyl, octadecenyl(oleyl), nonadecenyl, icosenyl, heneicosenyl, docosenyl, tricosenyl and tetracosenyl; cycloalkyl groups, such as cyclopentyl, cyclohexyl and cycloheptyl; alkylcycloalkyl groups, such as methylcyclopentyl, dimethylcyclopentyl, ethylcyclopentyl, propylcyclopentyl, ethylmethylcyclopentyl, trimethylcyclopentyl, diethylcyclopentyl, ethyldimethylcyclopentyl, propylmethylcyclopentyl, propylethylcyclopentyl, di-propylcyclopentyl, propylethylmethylcyclopentyl, methylcyclohexyl, dimethylcyclohexyl, ethylcyclohexyl, propylcyclohexyl, ethylmethylcyclohexyl, trimethylcyclohexyl, diethylcyclohexyl, ethyldimethylcyclohexyl, propylmethylcyclohexyl, propylethylcyclohexyl, di-propylcyclohexyl, propylethylmethylcyclohexyl, methylcycloheptyl, dimethylcycloheptyl, ethylcycloheptyl, propylcycloheptyl, ethylmethylcycloheptyl, trimethylcycloheptyl, diethylcycloheptyl, ethyldimethylcycloheptyl, propylmethylcycloheptyl, propylethylcycloheptyl, di-propylcycloheptyl and propylethylmethylcycloheptyl; aryl groups, such as phenyl and naphthyl; alkylaryl groups, such as tolyl, xylyl, ethylphenyl, propylphenyl, ethylmethylphenyl, trimethylphenyl, butylphenyl, propylmethylphenyl, diethylphenyl, ethyldimethylphenyl, tetramethylphenyl, pentylphenyl, hexylphenyl, heptylphenyl, octylphenyl, nonylphenyl, decylphenyl, undecylphenyl and dodecylphenyl; and arylalkyl groups, such as benzyl, methylbenzyl, dimethylbenzyl, phenethyl, methylphenethyl and dimethylphenethyl. These hydrocarbon groups include all possible isomeric groups. Among others, preferred are $C_1$–$C_{18}$ straight- or branched-chain alkyl group and $C_6$–$C_{18}$ aryl or straight- or branched-chain alkylaryl group.

Specific examples of the zinc dithiophosphate compounds are zinc diisopropyldithiophosphate, zinc diisobutyldithiophosphate, zinc di-sec-butyldithiophosphate, zinc di-sec-pentyldithioplhosphate, zinc di-n-hexyldithiophosphate, zinc di-sec-hexyldithiophosphate, zinc di-octyldithiophosphate, zinc di-2-ethylhexyldithiophosphate, zinc di-n-decyldithiophosphate zinc di-n-dodecyldithiophosphate, and zinc diisotridecyldithiophosphate.

The amount of the zinc dithiophosphate contained in the refrigeration oil is not particularly restricted. In order to obtain a larger friction reducing effect, the zinc dithiophosphate is preferably contained in an amount of 0.1% or less, more preferably in an amount of 0.06% or less, most preferably in a minimum effective amount, in terms of the phosphorus element based on the total mass of the refrigeration oil. When the amount of the zinc dithiophosphate in the refrigeration oil exceeds 0.1%, there is a possibility that the effect of the ashless fatty-ester friction modifier and/or the ashless aliphatic-amine friction modifier may become inhibited.

The production method of the zinc dithiophosphate is not particularly restricted, and the zinc dithiophosphate can be prepared by any known method. For example, the zinc dithiophosphate may be prepared by reacting alcohols or phenols having the above $R^4$, $R^5$, $R^6$ and $R^7$ hydrocarbon groups with phosphorous pentasulfide to form dithiophosphoric acid, and then, neutralizing the thus-formed dithiophosphoric acid with zinc oxide. It is noted that the molecular structure of zinc dithiophosphate differs according to the alcohols or phenols used as a raw material for the zinc dithiophosphate production.

The zinc dithiophosphate compounds can be used alone or in the form of a mixture of two or more thereof. In the case of using two or more zinc dithiophosphate compounds in combination, there is no particular limitation to the mixing ratio of the zinc dithiophosphate compounds.

The above-specified refrigeration oil provides a great friction reducing effect on the sliding friction between the hard-carbon coated sliding portion and the opposite sliding portion.

In order to improve the properties of the refrigeration oil, the refrigeration oil may further include any other additive or additives, such as a metallic detergent, an antioxidant, a viscosity index improver, a friction modifier other than the oxygen-containing organic friction modifier, an ashless dispersant other than the polybutenyl succinimide etc., an anti-wear agent or extreme-pressure agent, a rust inhibitor, a nonionic surfactant, a demulsifier, a metal deactivator and/or an anti-foaming agent.

The metallic detergent can be selected from any metallic detergent compound commonly used for lubricants. Specific examples of the metallic detergent include sulfonates, phenates and salicylates of alkali metals, such as sodium (Na) and potassium (K), or of alkali-earth metals, such as calcium (Ca) and magnesium (Mg); and mixtures of two or more thereof. Among others, sodium and calcium sulfonates, sodium and calcium phenates, and sodium and calcium salicylates are suitably used. The total base number and amount of the metallic detergent can be selected in accordance with the properties desired of the refrigeration oil. The total base number of the metallic detergent is usually 0 to 500 mgKOH/g, preferably 150 to 400 mgKOH/g, as measured by perchloric acid method according to ISO 3771. The amount of the metallic detergent is usually 0.1 to 10% based on the total mass of the refrigeration oil.

The antioxidant can be selected from any antioxidant compounds commonly used for lubricants. Specific examples of the antioxidant include: phenolic antioxidants, such as 4,4'-methylenebis(2,6-di-tert-butylphenol) and octadecyl-3-(3,5-di-tert-butyl-4-hydroxyphenyl)propionate; amino antioxidants, such as phenyl-α-naphthylamine, alkylphenyl-α-naphthylamine and alkyldiphenylamine; and mixtures of two or more thereof. The amount of the antioxidant is usually 0.01 to 5% based on the total mass of the refrigeration oil.

As the viscosity index improver, there may be used: non-dispersion type polymethacrylate viscosity index improvers, such as copolymers of one or more kinds of methacrylates and hydrogenated products thereof; dispersion type polymethacrylate viscosity index improvers, such as copolymers of methacrylates further including nitrogen compounds; and other viscosity index improvers, such as copolymers of ethylene and α-olefin (e.g. propylene, 1-butene and 1-pentene) and hydrogenated products thereof, polyisobutylenes and hydrogenated products thereof, styrene-diene hydrogenated copolymers, styrene-maleate anhydride copolymers and polyalkylstyrenes. The molecular weight of the viscosity index improver needs to be selected in view of the shear stability. For example, the number-average molecular weight of the viscosity index improver is desirably in a range of 5000 to 1000000, more desirably 100000 to 800000, for the dispersion or non-dispersion type polymethacrylates; in a range of 800 to 5000 for the polyisobutylene or hydrogenated product thereof; and in a range of 800 to 300000, more desirably 10000 to 200000 for the ethylene/α-olefin copolymer or hydrogenated product thereof. The above viscosity index improving compounds can be used alone or in the form of a mixture of two or more thereof. The amount of the viscosity index improver is preferably 0.1 to 40.0% based on the total mass of the refrigeration oil.

The friction modifier other than the oxygen-containing organic friction modifier can be any of ashless friction modifiers, such as boric acid esters, higher alcohols and aliphatic ethers, and metallic friction modifiers, such as molybdenum dithiophosphate, molybdenum dithiocarbamate and molybdenum disulfide.

The ashless dispersant other than the polybutenyl succinimide etc. can be any of polybutenylbenzylamines and polybutenylamines each having polybutenyl groups of which the number-average molecular weight is 900 to 3500, polybutenyl succinimides having polybutenyl groups of which the number-average molecular weight is less than 900, and derivatives thereof.

As the anti-friction agent or extreme-pressure agent, there may be used: disulfides, sulfurized fats, olefin sulfides, phosphate esters having one to three $C_2$–$C_{20}$ hydrocarbon groups, thiophosphate esters, phosphite esters, thiophosphite esters and amine salts of these esters.

As the rust inhibitor, there may be used: alkylbenzene sulfonates, dinonylnaphthalene sulfonates, esters of alkenylsuccinic acids and esters of polyalcohols.

As the nonionic surfactant and demulsifier, there may be used: noionic polyalkylene glycol surfactants, such as polyoxyethylene alkylethers, polyoxyethylene alkylphenylethers and polyoxyethylene alkylnaphthylethers.

The metal deactivator can be exemplified by imidazolines, pyrimidine derivatives, thiazole and benzotriazole.

The anti-foaming agent can be exemplified by silicones, fluorosilicones and fluoroalkylethers.

Each of the friction modifier other than the oxygen-containing organic friction modifier, the ashless dispersant other than the polybutenyl succinimide etc., the anti-wear agent or extreme-pressure agent, the rust inhibitor and the demulsifier is usually contained in an amount of 0.01 to 5% based on the total mass of the refrigeration oil, the metal deactivator is usually contained in an amount of 0.005 to 1% based on the total mass of the refrigeration oil, and the anti-foaming agent is usually contained in an amount of 0.0005 to 1% based on the total mass of the refrigeration oil.

Alternatively, there may be used as the lubricant a lubricating agent predominantly composed of a compound having a hydroxyl group in the first and second embodiments. Specific examples of such a hydroxyl group containing compound include alcohols. Among various alcohols, either glycerol or ethylene glycol is preferably used as the lubricant. The use of the hydroxyl group containing compound or compounds as the lubricant also produces a greater friction reducing effect on the sliding friction between the hard-carbon coated sliding portion and the opposite sliding portion.

Needless to say, each of refrigerant compressors 1 and 20 can be used in an air conditioner or a refrigerator etc. to compress a refrigerant. The refrigerant and the lubricant are held in their respective closed systems of refrigerant compressors 1 and 20. However, there is an unavoidable leaking of the refrigerant into the lubricant system as well as an unavoidable leaking of the lubricant into the refrigerant system. It is thus desired that the refrigerant and the lubricant are compatible with and stable toward each other. Although CFCs (chlorofluorocarbons) and HCFCs (hydrochlorofluorocarbons) are conventionally used as the refrigerant, alternative refrigerants e.g. HFCs (hydrofluorocarbons) have come into use in recent years. Also, there have been recently proposed $CO_2$ refrigerants and HC (hydrocarbon) refrigerants in consideration of the influence of CFCs and HCFCs on the environment. The lubricant needs to be selected suitably so as to ensure compatibility and stability against the refrigerant. Accordingly, there is a great potential of the use of the hydroxyl group containing compound as the lubricant in combination with these newly developed refrigerants and any other future refrigerants.

The present invention will be described in more detail with reference to the following examples. However, it should be noted that the following examples are only illustrative and not intended to limit the invention thereto.

Friction/Wear Test

Figure 3:
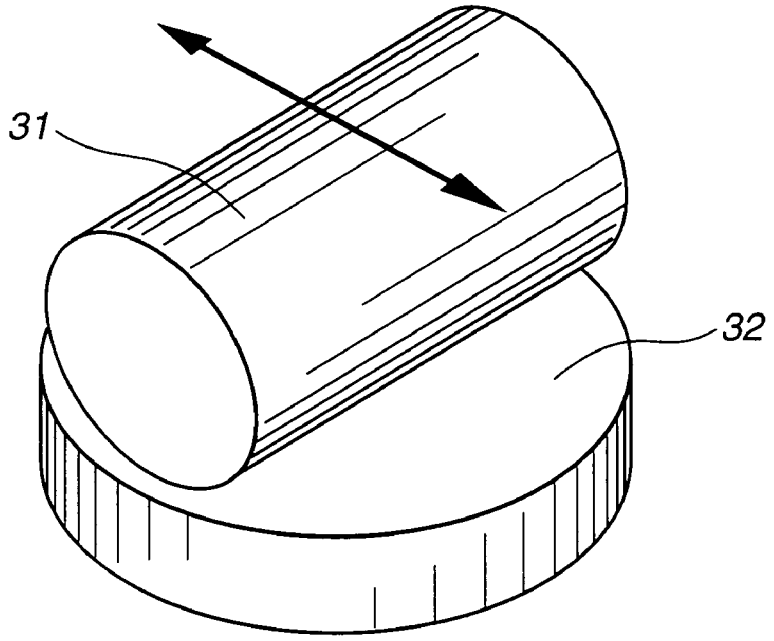
FIG. 3 is a schematic illustration showing a friction/wear test unit.
Figure 4:
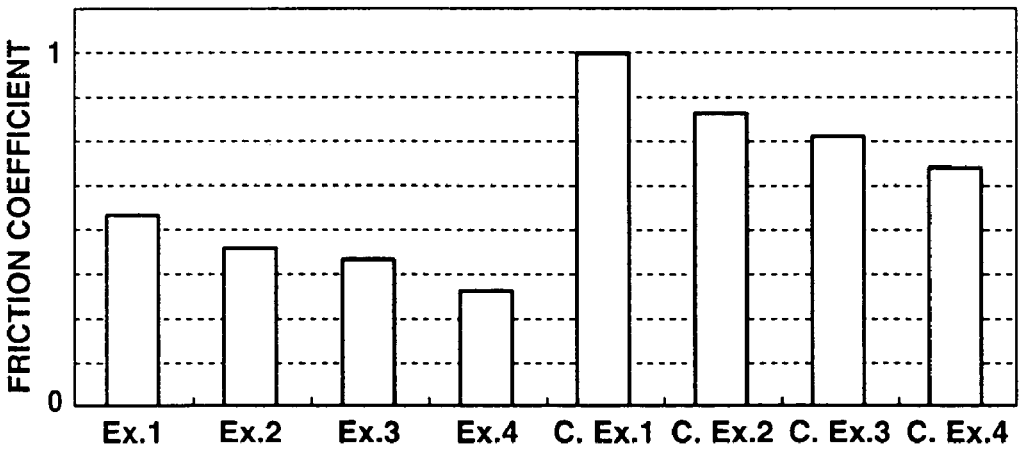
FIG. 4 is a graph showing the friction coefficients of test samples of Examples 1 to 5 and Comparative Examples 1 to 5.

Various sets of cylindrical-shaped pieces (31) and disc-shaped pieces (32) were prepared and subjected to friction/wear test so as to measure the coefficients of friction between the test pieces (31, 32) in Examples 1 to 5 and Comparative Examples 1 to 5. The friction/wear test was conducted under the following condition using a reciprocating friction/wear tester. In the tester, the cylindrical-shaped piece (31) was slid on the disc-shaped piece (32) in reciprocating directions, as indicated by a double-headed arrow in FIG. 3, while being pressed against the disc-shaped piece (32) under the application of a load. Further, the sliding interface between the cylindrical-shaped piece (31) and the disc-shaped piece (32) was lubricated with a refrigeration oil or lubricating agent. The combinations of the test pieces (31, 32) and the refrigeration oil or lubricating agent used are listed in TABLE, and the test results are shown in FIG. 4. In FIG. 4, the friction coefficients of Examples 1 to 5 and Comparative Examples 2 to 5 are indicated with respect to the friction coefficient of Comparative Example 1 (=1.0).

[Test conditions]

| | |
|---|---|
| Test unit: | Cylinder-on-Disc reciprocating friction/wear tester |
| Test pieces: | A cylindrical-shaped piece (31) with a diameter of 15 mm and a length of 22 mm; and<br>A disc-shaped piece (32) with a diameter of 24 mm and a thickness of 7.9 mm. |
| Load applied: | 400 N |
| Reciprocating pitch: | 3.0 mm |
| Frequency: | 50 Hz |
| Test temperature: | 80° C. |
| Test time: | 30 min. |

Preparation of Test Pieces

The cylindrical-shaped pieces (31) were cut from high carbon chromium bearing steel SUJ2 according to JIS G4805, machined to a dimension of 15 mm (diameter)×22 mm (length), and then, finished to a surface roughness Ra of 0.04 μm.

The disc-shaped pieces (32) were cut from high carbon chromium bearing steel SUJ2 according to JIS G4805, machined to a dimension of 24 mm (diameter)×7.0 mm (thickness), and finished to a surface roughness Ra of 0.05 μm. Then, the disc-shaped pieces (32) of Examples 1 to 5 were covered with DLC coatings, respectively, by PVD arc ion plating. The DLC coatings had a hydrogen content of 0.5 atomic % or less, a Knoop hardness Hk of 2170 kg/mm$^2$ and a surface roughness Ry of 0.03 μm. Herein, the surface roughness Ry is explained as Rz according to JIS B0601. The disc-shaped pieces (32) of Comparative Examples 1 to 5 were covered with no DLC coatings.

Preparation of Refrigeration Oil/Lubricating Agent

The refrigeration oil was prepared by mixing solvent-refined mineral oil or PAG (polyalkylene glycol) synthetic oil with glycerin monooleate (as ashless fatty acid friction modifier).

The lubricating agent was mainly composed of glycerol.

TABLE

| | Disc piece | | Cylinder piece | Refrigeration oil | | Lubricating Agent |
|---|---|---|---|---|---|---|
| | Base body | Coating | Base body | Base oil | Friction modifier | |
| Ex. 1 | SUJ2 | DLC | SUJ2 | Solvent-refined mineral oil | Glycerin monooleate (0.5%) | — |
| Ex. 2 | SUJ2 | DLC | SUJ2 | Solvent-refined mineral oil | Glycerin monooleate (1.0%) | — |
| Ex. 3 | SUJ2 | DLC | SUJ2 | PAG synthetic oil | Glycerin monooleate (0.5%) | — |
| Ex. 4 | SUJ2 | DLC | SUJ2 | PAG synthetic oil | Glycerin monooleate (1.0%) | — |
| Ex. 5 | SUJ2 | DLC | SUJ2 | — | — | Glycerol |
| C. Ex. 1 | SUJ2 | — | SUJ2 | Solvent-refined mineral oil | Glycerin monooleate (0.5%) | — |
| C. Ex. 2 | SUJ2 | — | SUJ2 | Solvent-refined mineral oil | Glycerin monooleate (1.0%) | — |
| C. Ex. 3 | SUJ2 | — | SUJ2 | PAG synthetic oil | Glycerin monooleate (0.5%) | — |
| C. Ex. 4 | SUJ2 | — | SUJ2 | PAG synthetic oil | Glycerin monooleate (1.0%) | — |
| C. Ex. 5 | SUJ2 | — | SUJ2 | — | — | Glycerol |

It is apparent from FIG. 4 that the test pieces (32) of Examples 1–5 (having the respective sliding portions covered with DLC coatings according to the present invention) had much lower friction coefficients than those of Comparative Examples 1–5 (having the respective sliding portions with no DLC coatings according to the earlier technology).

As described above, at least one of any opposed sliding portions of refrigerant compressor 1 or 20 has a thin coating of hard carbon low in hydrogen content in the first or second embodiment. With the specific refrigeration oil or lubricating agent supplied to the sliding interface between any opposed sliding portions of refrigerant compressor 1 or 20, it is therefore possible to improve the wear/seizure resistance of the sliding portions of the refrigerant compressor 1 or 20, lower the coefficient of friction between the sliding portions of refrigerant compressor 1 or 20 and, when refrigerant compressor 1 or 20 is used in e.g. an internal combustion engine, reduce engine load during air conditioning and increase engine fuel efficiency.

The entire contents of Japanese Patent Application No. 2003-208282 (filed on Aug. 21, 2003) and No. 2004-209495 (filed on Jul. 16, 2004) are herein incorporated by reference.

Although the present invention has been described with reference to specific embodiments of the invention, the invention is not limited to the above-described embodiments. Various modification and variation of the embodiments described above will occur to those skilled in the art in light of the above teaching. The scope of the invention is defined with reference to the following claims.

What is claimed is:

1. A refrigerant compressor, comprising:

compressor parts having sliding portions slidable relative to each other; and a refrigeration oil applied to the sliding portions of the compressor parts, wherein at least one of the sliding portions of the compressor parts comprises a hard carbon coating formed with a hydrogen content of 20 atomic % or less and wherein the refrigeration oil comprises at least one oxygen-containing organic compound as a friction modifier.

2. A refrigerant compressor according to claim 1, wherein the hard carbon coating has a hydrogen content of 10 atomic % or less.

3. A refrigerant compressor according to claim 2, wherein the hard carbon coating has a hydrogen content of 5 atomic % or less.

4. A refrigerant compressor according to claim 3, wherein the hard carbon coating has a hydrogen content of 0.5 atomic % or less.

5. A refrigerant compressor according to claim 1, wherein the sliding portion has a surface toughness Ra of 0.1 μm or smaller in a condition that the hard carbon coating has not yet been formed on the sliding portion.

6. A refrigerant compressor according to claim 1, wherein said at least one oxygen-containing compound is selected from the group consisting of alcohols, carboxylic acids, ethers, esters and derivatives thereof.

7. A refrigerant compressor according to claim 1, wherein the refrigeration oil has a base oil selected from the group consisting of mineral oils, synthetic oils and mixtures thereof.

8. A refrigerant compressor according to claim 1, the compressor parts including:

a drive shaft;

a bearing;

a wobble plate supported by the bearing so as to make a reciprocating motion upon rotation of the drive shaft;

a guide ball fitted to the wobble plate;

a guide pin having a sliding portion slidably inserted through a sliding portion of the guide ball;

a cylinder having a cylinder bore formed therein;

a piston having a sliding portion slidably disposed in a sliding portion of the cylinder bore; and a piston rod for transmitting the reciprocating motion of the wobble plate to the piston;

at least one of the sliding portions between the guide pin and the guide ball having a hard carbon coating formed with a hydrogen content of 20 atomic % or less; and at least one of the sliding portions between the piston and the cylinder bore having a hard carbon coating formed with a hydrogen content of 20 atomic % or less.

9. A refrigerant compressor according to claim 1, the compressor parts including:

a rotor shaft;

a rotor rotated together with the rotor shaft;

a plurality of vanes retractably attached to the rotor;

a ring disposed around the rotor and having a sliding portion slidable relative to a sliding portion of the rotor or vane; and a pair of side plates disposed on open ends of the ring and having respective sliding portions slidable relative to sliding portions of the rotor or vane;

at least one of the sliding portions between the ring and the rotor or vane having a hard carbon coating formed with a hydrogen content of 20 atomic % or less; and at least one of the sliding portions between the side plate and the rotor or vane having a hard carbon coating formed with a hydrogen content of 20 atomic % or less.

10. A refrigerant compressor, comprising:

compressor parts having sliding portions slidable relative to each other; and a lubricant predominantly comprises a hydroxyl group containing compound applied to the sliding portions of the compressor parts, wherein at least one of the sliding portions of the compressor parts comprises a hard carbon coating formed with a hydrogen content of 20 atomic % or less.

11. A refrigerant compressor according to claim 10, wherein the hydroxyl group containing compound is an alcohol.

12. A refrigerant compressor according to claim 11, wherein the alcohol is either glycerol or ethylene glycol.

13. A refrigerant compressor according to claim 10, wherein the hard carbon coating has a hydrogen content of 10 atomic % or less.

14. A refrigerant compressor according to claim 13, wherein the hard carbon coating has a hydrogen content of 5 atomic % or less.

15. A refrigerant compressor according to claim 14, wherein the hard carbon coating has a hydrogen content of 0.5 atomic % or less.

16. A refrigerant compressor according to claim 10, wherein the sliding portion has a surface roughness Ra of 0.1 μm or smaller in a condition that the hard carbon coating has not yet been formed on the sliding portion.

17. A refrigerant compressor according to claim 10, the compressor parts including:

a drive shaft;

a bearing;

a wobble plate supported by the bearing so as to make a reciprocating motion upon rotation of the drive shaft;

a guide ball fitted to the wobble plate;

a guide pin having a sliding portion slidably inserted through a sliding portion of the guide ball;

a cylinder having a cylinder bore formed therein;

a piston having a sliding portion slidably disposed in a sliding portion of the cylinder bore; and a piston rod for transmitting the reciprocating motion of the wobble plate to the piston;

at least one of the sliding portions between the guide pin and the guide ball having a hard carbon coating formed with a hydrogen content of 20 atomic % or less; and at least one of the sliding portions between the piston and the cylinder bore having a hard carbon coating formed with a hydrogen content of 20 atomic % or less.

18. A refrigerant compressor according to claim 10, the compressor parts including:

a rotor shaft;

a rotor rotated together with the rotor shaft;

a plurality of vanes retractably attached to the rotor;

a ring disposed around the rotor and having a sliding portion slidable relative to a sliding portion of the rotor or vane; and a pair of side plates disposed on open ends of the ring and having respective sliding portions slidable relative to sliding portions of the rotor or vane;

at least one of the sliding portions between the ring and the rotor or vane having a hard carbon coating formed with a hydrogen content of 20 atomic % or less; and at least one of the sliding portions between the side plate and the rotor or vane having a hard carbon coating formed with a hydrogen content of 20 atomic % or less.

19. A process for controlling sliding friction between compressor parts in a refrigerant compressor, the process comprising:

covering at least one of opposed sliding portions of the compressor parts with a hard carbon coating, while adjusting a hydrogen content of the hard carbon coating to 20 atomic % or less; and applying a refrigeration oil comprising an oxygen-containing organic friction modifier, to a sliding interface between the sliding portions of the compressor parts.

20. A process according to claim 19, wherein the hydrogen content of the hard carbon coating is controlled to 10 atomic % or less.

21. A process according to claim 20, wherein the hydrogen content of the hard carbon coating is controlled to 5 atomic % or less.

22. A process according to claim 21, wherein the hydrogen content of the hard carbon coating is controlled to 0.5 atomic % or less.

23. A process for controlling sliding friction between compressor parts in a refrigerant compressor, the process comprising:

covering at least one of opposed sliding portions of the compressor parts with a hard carbon coating, while adjusting a hydrogen content of the hard carbon coating to 20 atomic % or less; and applying a lubricant predominantly comprising of a hydroxyl group containing compound, to a sliding interface between the sliding portions of the compressor parts.

24. A process according to claim 23, wherein the hydrogen content of the hard carbon coating is controlled to 10 atomic % or less.

25. A process according to claim 24, wherein the hydrogen content of the hard carbon coating is controlled to 5 atomic % or less.

26. A process according to claim 25, wherein the hydrogen content of the hard carbon coating is controlled to 0.5 atomic % or less.

* * * * *